US011658420B2

(12) United States Patent
Kim et al.

(10) Patent No.: US 11,658,420 B2
(45) Date of Patent: May 23, 2023

(54) ANTENNA APPARATUS

(71) Applicant: SAMSUNG ELECTRO-MECHANICS CO., LTD., Suwon-si (KR)

(72) Inventors: Nam Ki Kim, Suwon-si (KR); Jeong Ki Ryoo, Suwon-si (KR); Kyu Bum Han, Suwon-si (KR); Young Kyoon Im, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 22 days.

(21) Appl. No.: 17/022,553

(22) Filed: Sep. 16, 2020

(65) Prior Publication Data

US 2020/0411997 A1 Dec. 31, 2020

Related U.S. Application Data

(63) Continuation of application No. 16/437,083, filed on Jun. 11, 2019, now Pat. No. 11,005,184.

(30) Foreign Application Priority Data

Nov. 29, 2018 (KR) ..... 10-2018-0151173
Mar. 5, 2019 (KR) ..... 10-2019-0025311

(51) Int. Cl.
*H01Q 1/52* (2006.01)
*H01Q 9/28* (2006.01)
(Continued)

(52) U.S. Cl.
CPC ..... *H01Q 9/285* (2013.01); *H01Q 1/243* (2013.01); *H01Q 1/48* (2013.01); *H01Q 1/521* (2013.01);
(Continued)

(58) Field of Classification Search
CPC ..... H01Q 1/52; H01Q 1/521; H01Q 1/523; H01Q 1/525; H01Q 1/526; H01Q 1/528
See application file for complete search history.

(56) References Cited

U.S. PATENT DOCUMENTS 10,033,100 B1 7/2018 Chayat et al.
2010/0220015 A1 9/2010 Pintos et al.
(Continued)

FOREIGN PATENT DOCUMENTS

CN 101075702 A 11/2007
CN 101820096 A 9/2010
(Continued)

OTHER PUBLICATIONS

United States Office Action dated Feb. 3, 2021 in related U.S. Appl. No. 16/437,083 (16 pages in English).
(Continued)

*Primary Examiner* — Daniel Munoz
(74) *Attorney, Agent, or Firm* — NSIP Law

(57) ABSTRACT

An antenna apparatus includes first dipole antenna patterns, feed lines, a first ground plane, and a first blocking pattern. The feed lines are connected to corresponding ones of the first dipole antenna patterns. The first ground plane is disposed on a side of the first dipole antenna patterns and spaced apart from each of the first dipole antenna patterns. The first blocking pattern, connected to and extending from the first ground plane, is disposed between adjacent ones of the first dipole antenna patterns.

23 Claims, 19 Drawing Sheets

(51) Int. Cl.

| | |
|---|---|
| ***H01Q 9/04*** | (2006.01) |
| ***H01Q 21/00*** | (2006.01) |
| ***H01Q 21/30*** | (2006.01) |
| ***H01Q 1/24*** | (2006.01) |
| ***H01Q 1/48*** | (2006.01) |
| ***H01Q 21/24*** | (2006.01) |
| ***H01Q 19/24*** | (2006.01) |
| ***H01Q 21/06*** | (2006.01) |
| ***H01Q 21/10*** | (2006.01) |

(52) U.S. Cl.
CPC ..... *H01Q 1/526* (2013.01); *H01Q 9/0407* (2013.01); *H01Q 19/24* (2013.01); *H01Q 21/0006* (2013.01); *H01Q 21/065* (2013.01); *H01Q 21/10* (2013.01); *H01Q 21/24* (2013.01); *H01Q 21/30* (2013.01)

(56) References Cited

U.S. PATENT DOCUMENTS

| | | | | |
|---|---|---|---|---|
| 2011/0234467 | A1 | 9/2011 | Huang et al. | |
| 2012/0194391 | A1 | 8/2012 | Liu et al. | |
| 2013/0252661 | A1 | 9/2013 | Holz et al. | |
| 2014/0361946 | A1 | 12/2014 | Ganchrow et al. | |
| 2014/0368396 | A1* | 12/2014 | Shinkai | H01Q 1/243 343/817 |
| 2015/0002359 | A1 | 1/2015 | Dong et al. | |
| 2015/0070228 | A1 | 3/2015 | Gu et al. | |
| 2015/0194736 | A1 | 7/2015 | Diukman et al. | |
| 2016/0087348 | A1 | 3/2016 | Ko et al. | |
| 2016/0294052 | A1 | 10/2016 | Baek et al. | |
| 2017/0117635 | A1 | 4/2017 | Ganchrow et al. | |
| 2017/0179025 | A1 | 6/2017 | Yun et al. | |
| 2017/0214119 | A1 | 7/2017 | Aoki | |
| 2018/0261906 | A1 | 9/2018 | Hill et al. | |
| 2019/0103653 | A1* | 4/2019 | Jeong | H01Q 1/2283 |
| 2019/0123425 | A1* | 4/2019 | Jeong | H01Q 1/243 |

FOREIGN PATENT DOCUMENTS

| | | | |
|---|---|---|---|
| CN | 103125082 | A | 5/2013 |
| CN | 104157982 | A | 11/2014 |
| CN | 105449345 | A | 3/2016 |
| CN | 105934851 | A | 9/2016 |
| CN | 106910742 | A | 6/2017 |
| CN | 106992357 | A | 7/2017 |
| EP | 2 369 677 | A1 | 9/2011 |
| JP | 2000-349548 | A | 12/2000 |
| JP | 2002-319809 | A | 10/2002 |
| JP | 2016-140046 | A | 8/2016 |
| KR | 10-2015-0130048 | A | 11/2015 |
| KR | 10-2016-0105870 | A | 9/2016 |
| WO | WO 2015/105605 | A1 | 7/2015 |

OTHER PUBLICATIONS

Korean Office Action dated Oct. 11, 2019 in corresponding Korean Patent Application No. 10-2019-0025311 (5 pages in English, 5 pages in Korean).

Chinese Office Action dated Sep. 5, 2022, in counterpart Chinese Patent Application No. 202011068714.8 (19 pages in English, 13 pages in Chinese).

Chinese Office Action and Search Report dated Mar. 24, 2023, in Counterpart Chinese Patent Application No. 201910856594.9 (20 Pages in English, 11 Pages in Chinese).

* cited by examiner

ANTENNA APPARATUS

CROSS-REFERENCE TO RELATED APPLICATION(S)

This application is a continuation of U.S. patent application Ser. No. 16/437,083 filed on Jun. 11, 2019, now U.S. Pat. No. 11,005,184 issued on May 11, 2021, which claims the benefit under 35 USC 119(a) of Korean Patent Application No. 10-2018-0151173 filed on Nov. 29, 2018 and Korean Patent Application No. 10-2019-0025311 filed on Mar. 5, 2019 in the Korean Intellectual Property Office, the entire disclosures of which are incorporated herein by references for all purposes.

BACKGROUND

1. Field

The following description relates to an antenna apparatus.

2. Description of Related Art

Mobile communications data traffic continually increases annually. Various techniques have been developed to support the rapid increment for real-time data in a wireless network. For example, conversion of Internet of Things (IoT)-based data into contents, such as augmented reality (AR), virtual reality (VR), live VR/AR linked with SNS, an automatic driving function, applications such as a sync view (transmission of real-time images from a user viewpoint using a compact camera), and the like, may require communications (e.g., 5G communications, mmWave communications, and the like) which support transmission and reception of large volumes of data.

Accordingly, there has been ongoing research on mmWave communications including 5th generation (5G), and the research into the commercialization and standardization of an antenna apparatus for implementing such communications.

An RF signal of a high-frequency band (e.g., 24 GHz, 28 GHz, 36 GHz, 39 GHz, 60 GHz, and the like) may easily be absorbed and lost during transmission, and the quality of communications may become degraded. Thus, an antenna for communications performed in a high-frequency band may require a technical approach different from techniques used in a general antenna, and a special technique such as a separate power amplifier, and the like, may be required to achieve antenna gain, integration of an antenna and an RFIC, effective isotropic radiated power (EIRP), and the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes first dipole antenna patterns, feed lines, a first ground plane, and a first blocking pattern. The feed lines are connected to corresponding ones of the first dipole antenna patterns. The first ground plane is disposed on a side of the first dipole antenna patterns and spaced apart from each of the first dipole antenna patterns. The first blocking pattern, connected to and extending from the first ground plane, is disposed between adjacent ones of the first dipole antenna patterns.

The antenna apparatus may further include a second ground plane disposed below the first ground plane and a second blocking pattern. The second blocking pattern may be connected to the second ground pattern, having at least a portion overlapping the first blocking pattern in a normal direction, and extending from the second ground plane.

The antenna apparatus may further include shielding vias disposed along a perimeter of the first ground plane and connected to the second ground plane. A region between the first blocking pattern and the second blocking pattern may be filled with an insulating layer.

The antenna apparatus may further include second dipole antenna patterns disposed below corresponding ones of the first dipole antenna patterns and radial vias connecting the first dipole antenna patterns and the second dipole antenna patterns.

The antenna apparatus may further include a third ground plane disposed in below of the first ground plane and a third blocking pattern, connected to and extending from the third ground plane, disposed between adjacent ones of the second dipole antenna patterns.

The antenna apparatus may further include director patterns disposed on an outer side of, and spaced apart from, corresponding ones of the second dipole antenna patterns. A region in the outer side of the first dipole antenna pattern overlapping the director patterns in a normal direction may be filled with an insulating layer.

The antenna apparatus may further include director patterns disposed on an outer side of, and spaced apart from, corresponding ones of the first dipole antenna patterns. The first blocking pattern may extend to the outer side by a length corresponding to a region between the first dipole antenna patterns and the director patterns.

End portions of the first dipole antenna patterns may be received into recessed portions of the first ground plane.

The first blocking pattern may extend from one of the recessed portions.

The antenna apparatus may further include first feed vias connecting the first dipole antenna patterns and the feed lines. The first ground plane may include a portion protruding towards the first feed vias within the one of the recessed portions of the first ground plane.

The antenna apparatus may further include patch antenna patterns disposed below the first ground plane and second feed vias connecting the patch antenna patterns.

The antenna apparatus may further include a coupling member surrounding each of the patch antenna patterns. A perimeter or a portion of the coupling member may overlap a perimeter of the first ground plane in a normal direction.

In another general aspect, an antenna apparatus includes first dipole antenna patterns, feed lines connected to corresponding ones of the first dipole antenna patterns, a first ground plane disposed on a side of the first dipole antenna patterns and spaced apart from each of the first dipole antenna patterns, and a first blocking pattern, electrically isolated from the first ground plane, disposed between adjacent ones of the first dipole antenna patterns.

The first blocking pattern may include coupling patterns spaced apart from each other.

A width of one end of the first blocking pattern may be smaller than a width of another end of the first blocking pattern.

The antenna apparatus may further include a second ground plane disposed in below the first ground plane, and a second blocking pattern connected to the second ground plane, having at least a portion overlapping the first blocking pattern in a normal direction, and extending from the second ground plane.

In another general aspect, an antenna apparatus includes first dipole antenna patterns, ground planes disposed on a side of each of the first dipole antenna patterns and spaced apart from each of the first dipole antenna patterns, first and second feed lines connected on one end to one of the first dipole antenna patterns and on another end to one of the ground planes, and a first blocking pattern, connected to and extending from the first ground plane, disposed between adjacent ones of the first dipole antenna patterns.

The another end to the one of the ground planes may have a stepped contour.

The antenna apparatus may further include director patterns disposed on an outer side of, and spaced apart from, corresponding ones of the first dipole antenna patterns.

The first blocking pattern may extend beyond the first dipole antenna patterns.

The first blocking pattern may extend below upper surfaces of the first dipole antenna patterns.

A width of one end of the first blocking pattern may be smaller than a width of another end of the first blocking pattern. The first and second feed lines may be configured to receive and/or transmit signals differentially to the one of the first dipole antenna patterns.

Other features and aspects will be apparent from the following detailed description, the drawings, and the claims.

BRIEF DESCRIPTION OF DRAWINGS

FIGS. 10A to 100 are plan diagrams illustrating an arrangement of antenna apparatuses in an electronic device according to an example embodiment of the present disclosure.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
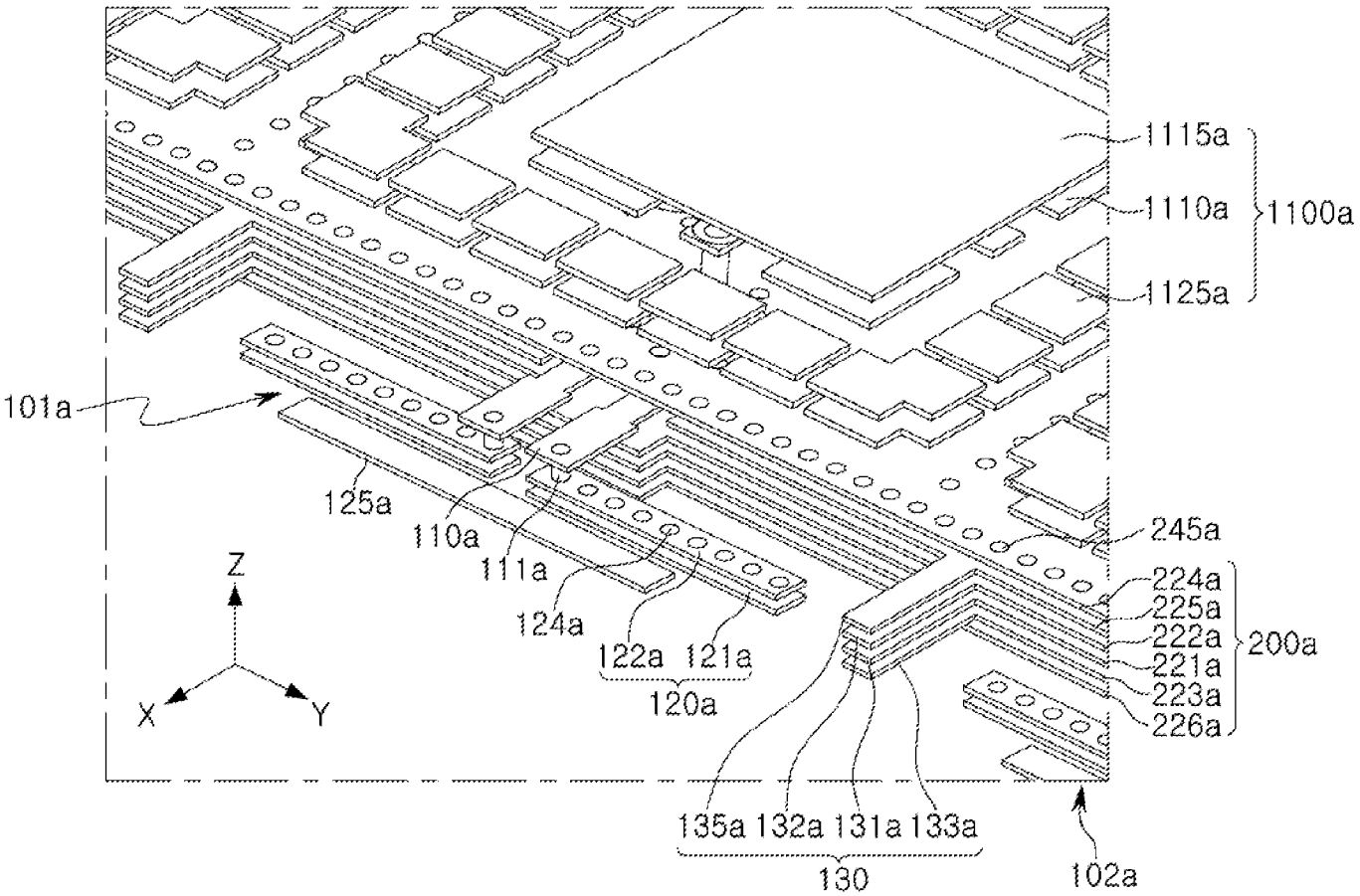
FIGS. 1A and 1B are perspective diagrams illustrating an antenna apparatus according to an example embodiment of the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Figure 1B:
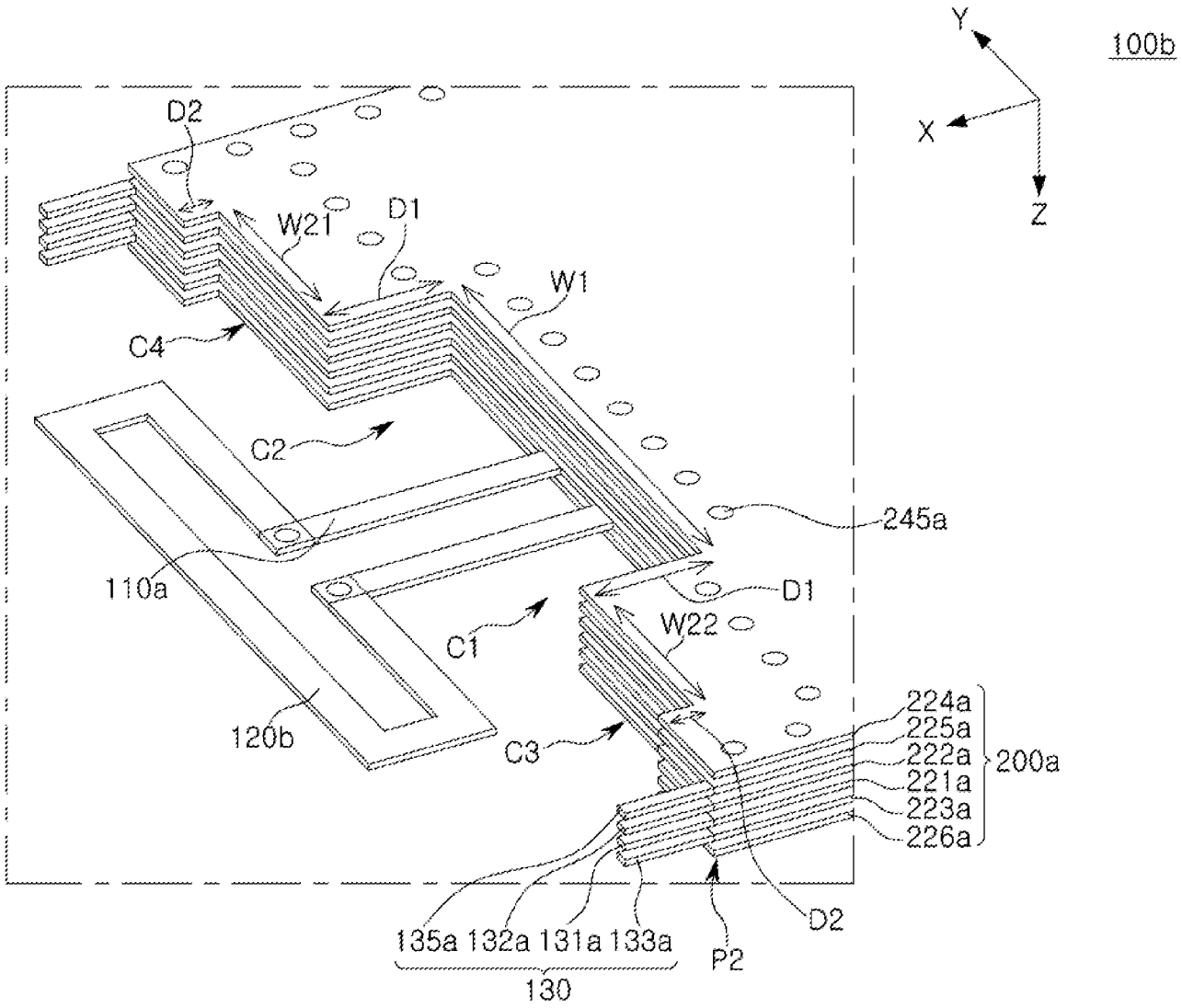
Figure 2:
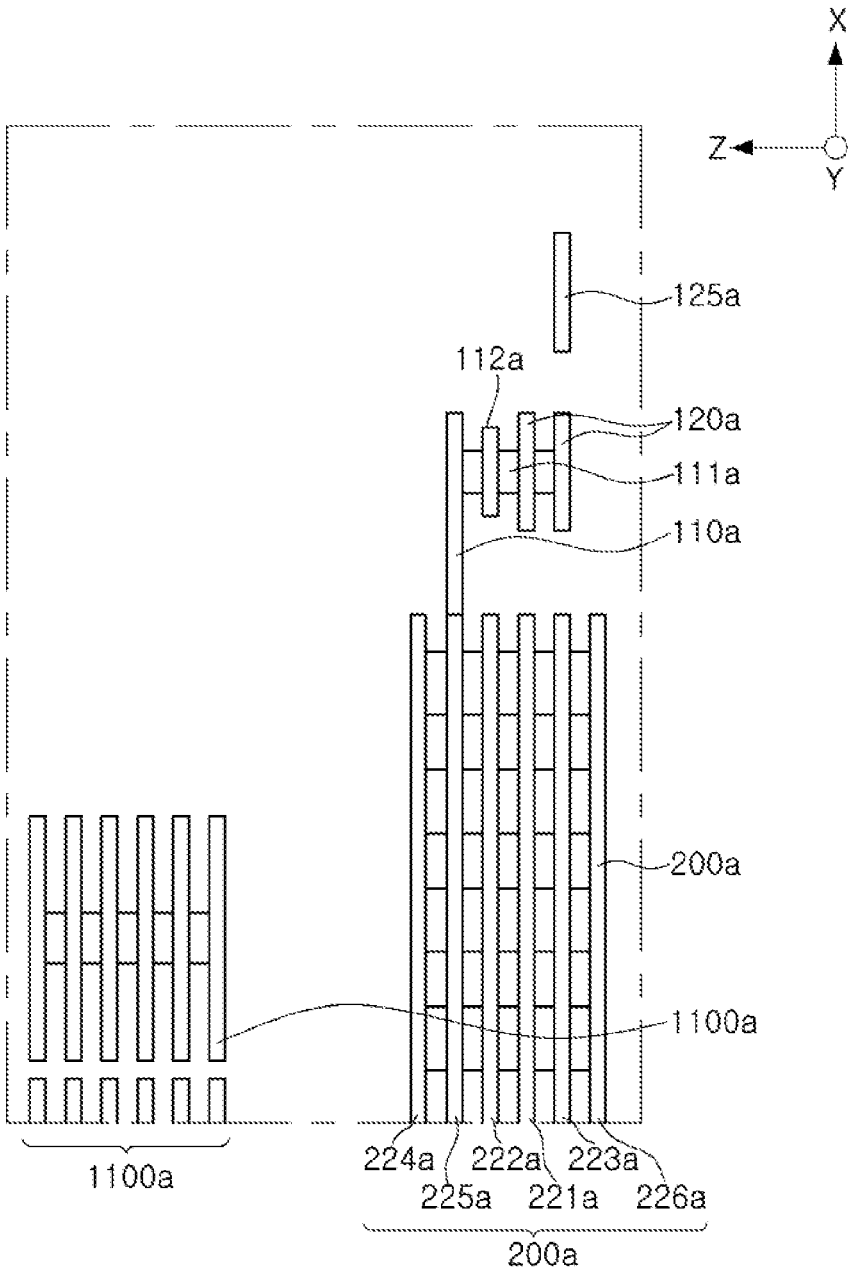
FIG. 2 is a lateral view of an antenna apparatus according to an example embodiment of the present disclosure.
Figure 3:
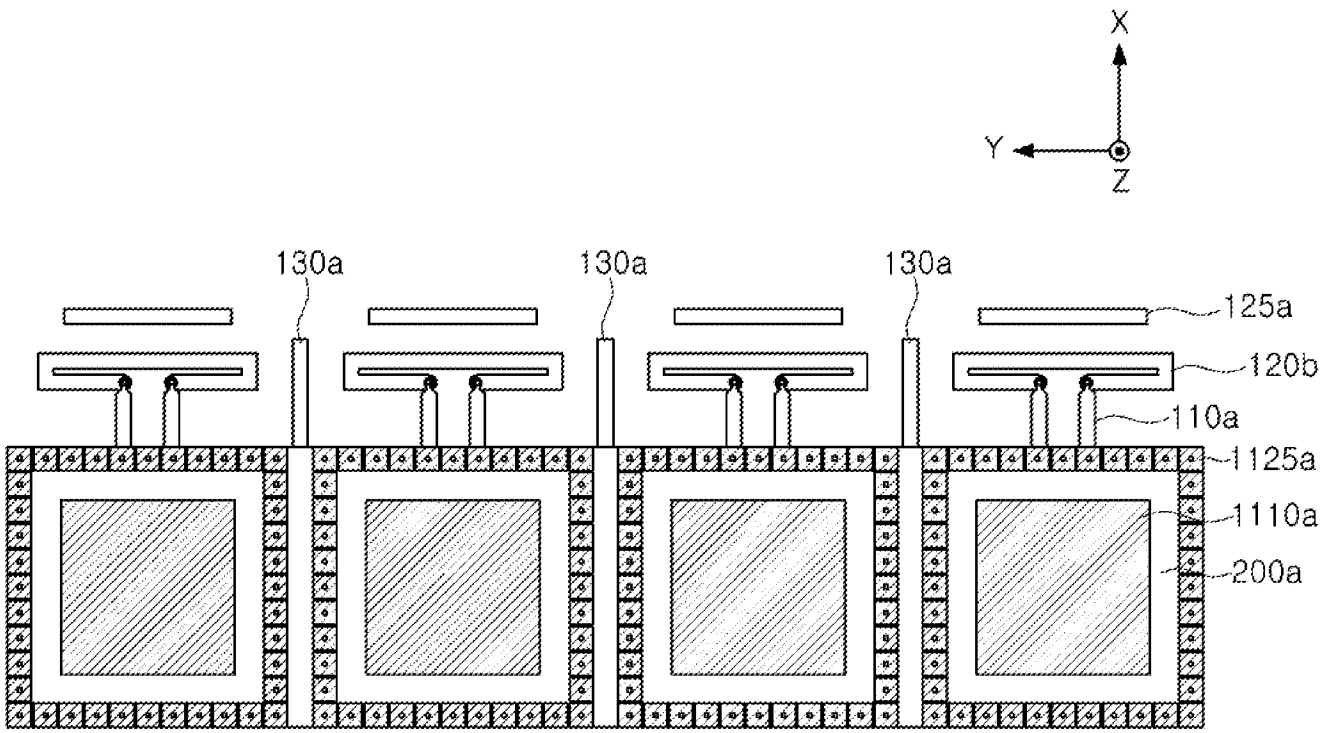
FIG. 3 is a plan diagram illustrating an antenna apparatus according to an example embodiment of the present disclosure.

FIGS. 1A and 1B are perspective diagrams illustrating an antenna apparatus according to an example embodiment. FIG. 2 is a lateral view of an antenna apparatus according to an example embodiment. FIG. 3 is a plan diagram illustrating an antenna apparatus according to an example embodiment.

Referring to FIGS. 1A, 2, and 3, an antenna apparatus in the example embodiment may include at least portions of a feed line 110*a*, a feed via 111*a*, a dipole antenna pattern 120*a*, a director pattern 125*a*, and a connection member 200*a*.

The dipole antenna pattern 120*a* may receive a radio frequency (RF) signal from the connection member 200*a* via the feed line 110*a* and may remotely transmit the signal in an x-direction, or may remotely receive an RF signal in the x-direction and may transfer the signal to the connection member 200*a* via the feed line 110*a*. For example, the dipole antenna pattern 120*a* may have a dipole form, and may thus have a structure extending in a y-direction.

The feed line 110*a* may be electrically connected to a wiring line in the connection member 200*a* and may function as a transfer pathway for an RF signal. As the dipole antenna pattern 120*a* is disposed adjacently to a side surface of the connection member 200*a*, the feed line 110*a* may have a structure extending towards the dipole antenna pattern 120*a* from a wiring line of the connection member 200*a*.

For example, the feed line 110*a* may include first and second feed lines. For example, the first feed line may be configured to transfer an RF signal to the dipole antenna pattern 120*a*, and the second feed line may be configured to receive an RF signal from the dipole antenna pattern 120*a*. For example, the first feed line may be configured to receive an RF signal from the dipole antenna pattern 120*a* or to transfer an RF signal to the dipole antenna pattern 120*a*, and the second feed line may be configured to provide an impedance to the dipole antenna pattern 120*a*.

For example, the first and second feed lines transferring RF signals to the dipole antenna pattern 120*a* and receiving RF signals to the dipole antenna pattern 120*a* may be configured through a differential feeding method to have a phase difference between the first and second feed line (e.g., 180 degrees, 90 degrees). The phase difference may be implemented by a phase shifter of an IC or by a difference between electrical lengths of the first and second feed lines. The differential feeding method, as opposed to the conventional single-ended feeding method, may improve the co-polarization/cross-polarization characteristics by eliminating radiation pattern distortions of the dipole antenna.

In example embodiments, the feed line 110*a* may include a ¼ wavelength converter, a balun, or an impedance converting line to improve an RF signal transmission efficiency. However, depending on design, any one of ¼ wavelength converter, a balun, or an impedance converting line may not be needed.

The feed via 111*a* may be disposed to electrically connect the dipole antenna pattern 120*a* and the feed line 110*a*. The feed via 111*a* may be disposed perpendicularly to the dipole antenna pattern 120*a* and the feed line 110*a*. When the dipole antenna pattern 120*a* and the feed line 110*a* are disposed at the same height, the feed via 111*a* may not be provided.

Due to the feed via 111*a*, the dipole antenna pattern 120*a* may be positioned lower or higher than the feed line 110*a*. The specific position of the dipole antenna pattern 120*a* may vary depending on a length of the feed via 111*a*, and thus, a direction of a radial pattern of the dipole antenna pattern 120*a* may be inclined in the vertical or normal direction (a z-direction) depending on a design of a length of the feed via 111*a*.

A via pattern 112*a* may be coupled to the feed via 111*a* and may support an upper level and a lower level of the feed via 111*a*.

The dipole antenna pattern 120*a* may be electrically connected to the feed line 110*a* and may transmit or receive RF signals. Each pole of the dipole antenna pattern 120*a* may be electrically connected to the first and second lines of the feed line 110*a*.

The dipole antenna pattern 120*a* may have a frequency band (e.g., 28 GHz, 60 GHz) in accordance with at least one of a length of a pole, a thickness of a pole, a gap between poles, a gap between a pole and side surfaces of the connection member, and a dielectric constant of an insulating layer.

The director pattern 125*a* may be spaced apart from the dipole antenna pattern 120*a* in a lateral direction. The director pattern 125*a* may be electromagnetically coupled to the dipole antenna pattern 120*a* and may improve a gain or a bandwidth of the dipole antenna pattern 120*a*. The director pattern 125*a* may have a length shorter than the overall length of a dipole of the dipole antenna pattern 120*a*, and thus, the degree of concentration of the electromagnetic coupling of the dipole antenna pattern 120*a* may further improve. Thus, a gain or directivity of the dipole antenna pattern 120*a* may further improve.

Referring to FIGS. 1A, 2, and 3, an antenna apparatus in the example embodiment may include blocking patterns 130 and 130*a*.

The blocking patterns 130 and 130*a* may be electrically connected to the connection member 200*a*, and may extend to the front from at least one of first, second, third, and fifth ground planes 221*a*, 222*a*, 223*a*, and 225*a* such that a portion of the blocking patterns 130 and 130*a* may be disposed between a plurality of dipole antenna patterns 120*a*.

The blocking patterns 130 and 130*a* may work as reflectors for the plurality of dipole antenna patterns 120*a*, and may thus reflect RF signals leaking in a y-direction in the plurality of dipole antenna patterns 120*a*. The overall RF signals reflected from the blocking patterns 130 and 130*a* may be induced in an x-direction in accordance with offset interference of y-direction vector elements and/or reinforcement interference of x-direction vector elements. Accordingly, a gain and/or directivity of the plurality of dipole antenna patterns 120*a* may improve.

The blocking patterns 130 and 130*a* may be disposed to block spaces between the plurality of dipole antenna patterns 120*a*, and may electromagnetically isolate the plurality of dipole antenna patterns 120*a* from each other. Accordingly, the plurality of dipole antenna patterns 120*a* may become adjacent to each other while preventing offset interference therebetween. Thus, overall sizes based on antenna performance of the plurality of dipole antenna patterns 120*a* may reduce.

The blocking patterns 130 and 130*a* may be stacked in a z-direction, and may thus provide a space for arranging the dipole antenna patterns 120*a* in a z-direction, and may improve electromagnetic isolation formed in a y-direction between the dipole antenna patterns 120*a* arranged in a z-direction.

For example, the dipole antenna patterns 120*a* may have a structure in which first and second dipole antenna patterns 121*a* and 122*a* are combined with a radial via 124*a*. Thus, the dipole antenna patterns 120*a* may be stacked in a z-direction. The plurality of dipole antenna patterns 120*a* stacked in a z-direction may have a structure in which an electromagnetic surface is expanded in an x-direction, and may thus have an improved gain and/or a bandwidth. The plurality of dipole antenna patterns 120*a* stacked in a z-direction may be designed to transmit and receive a horizontal pole RF signal (an H-pole RF signal) and a vertical pole RF signal (a V-pole RF signal), respectively, which are in a polarization relationship with each other, or may have different bandwidths to support dual-band transmission and reception.

The blocking patterns 130 and 130*a* may achieve merits of the structure in which the blocking patterns 130 and 130*a* are stacked in the z-direction, and may improve electromagnetic isolation in a y-direction.

The blocking patterns 130 and 130*a* may be electromagnetically coupled to the dipole antenna pattern 120*a*, and may thus provide an impedance to the dipole antenna patterns 120*a*. The dipole antenna patterns 120*a* may further have a resonance frequency or shift a fundamental resonance frequency based on the blocking patterns 130 and 130*a*. Accordingly, based on design, the dipole antenna patterns 120*a* may easily broaden a bandwidth and/or may have a dual bandwidth (e.g., a bandwidth covering 28 GHz and 39 GHz).

The blocking patterns 130 and 130*a* may easily be processed and/or changed as compared to the dipole antenna patterns 120*a*, and may thus provide elements affecting antenna performance (e.g., a gain, a bandwidth, directivity, and the like) of the dipole antenna patterns 120*a* in addition to impedance. Accordingly, antenna performance of the dipole antenna patterns 120*a* may easily be optimized. For example, the blocking patterns 130 and 130*a* may have a structure in which a plurality of patterns are repeatedly arranged, or may be designed to have a diagonal perimeter in the x-direction/the y-direction.

The blocking patterns 130 and 130*a* may provide a path through which surface current concentrated at a certain position of the antenna apparatus may be externally emitted.

For example, the dipole antenna patterns 120*a* may transmit and receive a horizontal pole RF signal (an H-pole RF signal) and a vertical pole RF signal (a V-pole RF signal) which are in a polarization relationship with each other together and may improve a transmission and reception rate. The H-pole RF signal may cause surface current concentrated at an edge of the antenna apparatus and flowing in the y-direction, and the blocking patterns 130 and 130*a* may provide a path through which the surface current flowing in the y-direction is emitted in the x-direction. Accordingly, electromagnetic offset interference between the plurality of dipole antenna patterns 120*a* may be prevented, and thus, the overall gain and/or directivity of the dipole antenna pattern 120*a* may improve.

Referring to FIG. 1B, a dipole antenna pattern 120*b* may be a folded dipole, and a feed via, a director pattern, and a first protrusion region may be omitted.

The connection member 200*a* may be configured to be recessed into or receive the rear of the dipole antenna pattern 120*a*. The connection member 200*a* may thus include first, second, third, and fourth cavities C1, C2, C3, and C4.

The connection member 200*a* may include at least portions of a first ground plane 221*a*, a second ground plane 222*a*, a third ground plane 223*a*, a fourth ground plane 224*a*, a fifth ground plane 225*a*, and a sixth ground plane 226*a*, and may further include an insulating layer disposed between the plurality of ground planes. The first to sixth ground planes 221*a*, 222*a*, 223*a*, 224*a*, 225*a*, and 226*a* may be spaced apart from each other in the vertical or normal direction (a z-direction).

The antenna apparatus in the example embodiment may include at least one of the first to sixth ground planes 221*a*, 222*a*, 223*a*, 224*a*, 225*a*, and 226*a*. The number of the first to sixth ground planes 221*a*, 222*a*, 223*a*, 224*a*, 225*a*, and 226*a* and upward and downward relationships of the first to sixth ground planes 221*a*, 222*a*, 223*a*, 224*a*, 225*a*, and 226*a* may vary depending on a design of the antenna apparatus.

Thus, the specific configuration of each of the first to sixth ground planes 221*a*, 222*a*, 223*a*, 224*a*, 225*a*, and 226*a* and specific configuration of the other ground plane may be replaceable with each other.

The first, third, and sixth ground planes 221*a*, 223*a*, and 226*a* may provide a ground used in a circuit of an IC and/or a passive component as an IC and/or a passive component. Also, the first, third, and sixth ground planes 221*a*, 223*a*, and 226*a* may provide a transfer pathway for power and signals used in an IC and/or a passive component. Thus, the first, third, and sixth ground planes 221*a*, 223*a*, and 226*a* may be electrically connected to an IC and/or a passive component.

The first, third, and sixth ground planes 221*a*, 223*a*, and 226*a* may be omitted depending on ground consumption of an IC and/or a passive component. The first, third, and sixth ground planes 221*a*, 223*a*, and 226*a* may have a through-hole through which a wiring via penetrate.

The fifth ground plane 225*a* may be disposed in an upper level of the first, third, and sixth ground planes 221*a*, 223*a*, and 226*a* and may be spaced apart from the first, third, and sixth ground planes 221*a*, 223*a*, and 226*a*, and may be configured to surround the wiring line at a height the same as the height of the wiring line in which an RF signal flows. The wiring line may be electrically connected to the IC through the wiring via.

The second and fourth ground planes 222*a* and 224*a* may be disposed in an upper level of the first, third, and sixth ground planes 221*a*, 223*a*, and 226*a* and may be spaced apart from the first, third, and sixth ground planes 221*a*, 223*a*, and 226*a*, and may be disposed in a lower level and an upper level of the fifth ground plane 225*a*. The second ground plane 222*a* may improve electromagnetic isolation between the wiring line and the IC and may provide a ground to the IC and/or the passive component. The fourth ground plane 224*a* may improve electromagnetic isolation between the wiring line and a patch antenna pattern, and may provide a boundary condition in view of the patch antenna pattern and may reflect an RF signal transmitted and received by the patch antenna pattern such that transmission and reception directions of the patch antenna pattern may further be concentrated.

Boundaries of the first, second, third, fifth, and sixth ground planes 221*a*, 222*a*, 223*a*, 225*a*, and 226*a* may overlap each other in the vertical or normal direction (a z-direction). The boundaries may work as a reflector for the dipole antenna pattern 120*a*, and thus, a effective separation distance between the first, second, third, fifth, and sixth ground planes 221*a*, 222*a*, 223*a*, 225*a*, and 226*a* and the dipole antenna pattern 120*a* may affect antenna performance of the dipole antenna pattern 120*a*.

For example, when the effective separation distance is shorter than a reference distance, a gain of the dipole antenna pattern 120*a* may be deteriorated as RF signals penetrating the dipole antenna pattern 120*a* are distributed, and it may be difficult to optimize a resonance frequency of the dipole antenna pattern 120*a* as capacitance between the first, second, third, fifth, and sixth ground planes 221*a*, 222*a*, 223*a*, 225*a*, and 226*a* and the dipole antenna pattern 120*a* increases. Accordingly, a compensation interference ratio between RF signals penetrating the dipole antenna pattern 120*a* in an x-direction and RF signals being reflected from the first, second, third, fifth, and sixth ground planes 221*a*, 222*a*, 223*a*, 225*a*, and 226*a* may decrease.

Also, when the dipole antenna pattern 120*a* is spaced away from the first, second, third, fifth, and sixth ground planes 221*a*, 222*a*, 223*a*, 225*a*, and 226*a*, the size of the antenna apparatus may increase.

When the size of the connection member 200*a* decreases, a transfer pathway for power and a signal and a space in which wiring lines are disposed may decrease, ground stability of the ground planes may be deteriorated, and a space in which the patch antenna pattern is disposed may also decrease. In other words, performance of an antenna apparatus may be deteriorated.

The antenna apparatus in the example embodiment may have a structure in which the dipole antenna pattern 120*a* may be disposed adjacently to the first, second, third, fifth, and sixth ground planes 221*a*, 222*a*, 223*a*, 225*a*, and 226*a*, and a effective separation distance between the first, third, fourth and fifth ground planes 221*a*, 223*a*, 224*a*, and 225*a* and the dipole antenna pattern 120*a* may be achieved. Accordingly, the antenna apparatus may be reduced in size or may have improved performance.

At least one of the first, second, third, fifth, and sixth ground planes 221*a*, 222*a*, 223*a*, 225*a*, and 226*a* included in the connection member 200*a* may have a plurality of second protrusion regions P2.

Due to the plurality of second protrusion regions P2, a boundary of at least one of the first, second, third, fifth, and sixth ground planes 221*a*, 222*a*, 223*a*, 225*a*, and 226*a* facing the dipole antenna pattern 120*a* may have a serrated structure. Thus, first, second, third, and fourth cavities C1, C2, C3, and C4 may be formed between each of the plurality of second protrusion regions P2 and may provide boundary conditions which may achieve antenna performance of the dipole antenna pattern 120*a*.

The boundary of at least one of the first, second, third, fifth, and sixth ground planes 221*a*, 222*a*, 223*a*, 225*a*, and 226*a* facing the dipole antenna pattern 120*a* may work as a reflector for the dipole antenna pattern 120*a*, and thus, portions of RF signals penetrating the dipole antenna pattern 120*a* may be reflected from at least one of boundaries of the first, second, third, fifth, and sixth ground planes 221*a*, 222*a*, 223*a*, 225*a*, and 226*a*.

The first, second, third, and fourth cavities C1, C2, C3, and C4 may have a structure recessed towards at least one of the first, second, third, fifth, and sixth ground planes 221*a*, 222*a*, 223*a*, 225*a*, and 226*a* between one ends and the other ends of first and second poles of the dipole antenna pattern 120*a*. Thus, the first, second, third, and fourth cavities C1, C2, C3, and C4 may work as a reflector for the first and second poles of the dipole antenna pattern 120*a*.

Accordingly, a effective separation distance to at least one of the first, second, third, fifth, and sixth ground planes 221*a*, 222*a*, 223*a*, 225*a*, and 226*a* from each pole of the dipole antenna pattern 120*a* may be elongated without substantially changing a position of the dipole antenna pattern 120*a*. Alternatively, without substantially sacrificing antenna performance, the dipole antenna pattern 120*a* may be disposed adjacently to the first, second, third, fifth, and sixth ground planes 221*a*, 222*a*, 223*a*, 225*a*, and 226*a*.

For example, RF signals directed to the first, second, third, and fourth cavities C1, C2, C3, and C4 among RF signals penetrating at each pole of the dipole antenna pattern 120*a* may be more concentrated in an x-direction and reflected than in the example in which the first, second, third, and fourth cavities C1, C2, C3, and C4 are not provided. Thus, a gain of the dipole antenna pattern 120*a* may further improve, as compared to the example in which the first and second cavities CT1 and CT2 are not provided.

For example, capacitance between each pole of the dipole antenna pattern 120*a* and the first, second, third, fifth, and sixth ground planes 221*a*, 222*a*, 223*a*, 225*a*, and 226*a* may decrease further than in the example in which the first, second, third, and fourth cavities C1, C2, C3, and C4 are not provided. Thus, a resonance frequency of the dipole antenna pattern 120*a* may easily be optimized.

Also, the plurality of second protrusion regions P2 may electromagnetically shield a space between the dipole antenna pattern 120*a* and an adjacent antenna apparatus. Accordingly, an isolation distance between the dipole antenna pattern 120*a* and an adjacent antenna apparatus may further decrease, and the size of the antenna module in the example embodiment may be reduced.

The connection member 200*a* may further include a plurality of shielding vias 245*a* electrically connected to at least two of the first, second, third, fifth, and sixth ground planes 221*a*, 222*a*, 223*a*, 225*a*, and 226*a*, and surrounding at least a portion of each of the first, second, third, and fourth cavities C1, C2, C3, and C4 in the vertical or normal direction (a z-direction).

The plurality of shielding vias 245*a* may reflect RF signals leaking from gaps between the first, second, third, fifth, and sixth ground planes 221*a*, 222*a*, 223*a*, 225*a*, and 226*a* among RF signals penetrating the dipole antenna pattern 120*a*. Accordingly, a gain of the dipole antenna pattern 120*a* may further improve, and electromagnetic isolation between the dipole antenna pattern 120*a* and wiring lines may improve.

A patch antenna package 1100*a* may include a patch antenna pattern 1110*a*, an upper coupling pattern 1115*a*, and a coupling member 1125*a* and may remotely transmit and/or receive an RF signal in a +z-direction.

The patch antenna package 1100*a* may be disposed in an upper level of the connection member 200*a*, and may be electrically connected to a wiring line in the connection member 200*a* through a second feed via.

The antenna apparatuses 101*a* and 102*a* and the patch antenna package 1100*a* may be arranged in a 1×n arrangement, such as a 1×2 arrangement, a 1×3 arrangement, or a 1×4 arrangement, where n may be a natural number, and the number of the stop walls may be (n−1), and if the stop walls are further added to an edge, the number of the stop walls may be (n+1).

A coupling member 1125*a* may have a structure in which a plurality of patterns are repeatedly arranged, and may improve electromagnetic isolation between the plurality of patch antenna patterns 1110*a*, or may induce RF signals of the patch antenna patterns 1110*a* to an upper level (e.g., a z-direction) and may improve a gain and/or directivity. Also, the coupling member 1125*a* may be electromagnetically coupled to the patch antenna pattern 1110*a* and may provide an impedance to the patch antenna patterns 1110*a*, thereby expanding the bandwidth of the patch antenna patterns 1110*a*. The coupling member 1125*a* may improve electromagnetic isolation between the patch antenna pattern 1110*a* and the dipole antenna pattern 120*a*.

Referring to FIG. 3, a perimeter or a portion of the coupling member 1125*a* may overlap a front perimeter of a ground plane of the connection member 200*a* in the vertical or normal direction. Accordingly, the coupling member 1125*a* may effectively isolate the patch antenna pattern 1110*a* from the dipole antenna pattern 120*a*, and depending on a space efficiency of the arrangement of the coupling member 1125*a*, the overall size of the antenna apparatus in the example embodiment may reduce.

Although electromagnetic energy of a front perimeter of a ground plane of the connection member 200*a* may further be concentrated due to the dipole antenna pattern 120*a* and the coupling member 1125*a*, blocking patterns 130 and 130*a* may radiate the electromagnetic energy to the front (e.g., x-direction). Thus, overall electromagnetic noise of the antenna apparatus in the example embodiment may be reduced, and electromagnetic isolation between the dipole antenna pattern 120*a* and the patch antenna patterns 1110*a* may further improve.

FIGS. 4A to 4G are plan diagrams illustrating various structures of a blocking pattern of an antenna apparatus according to an example embodiment.

Figure 4A:
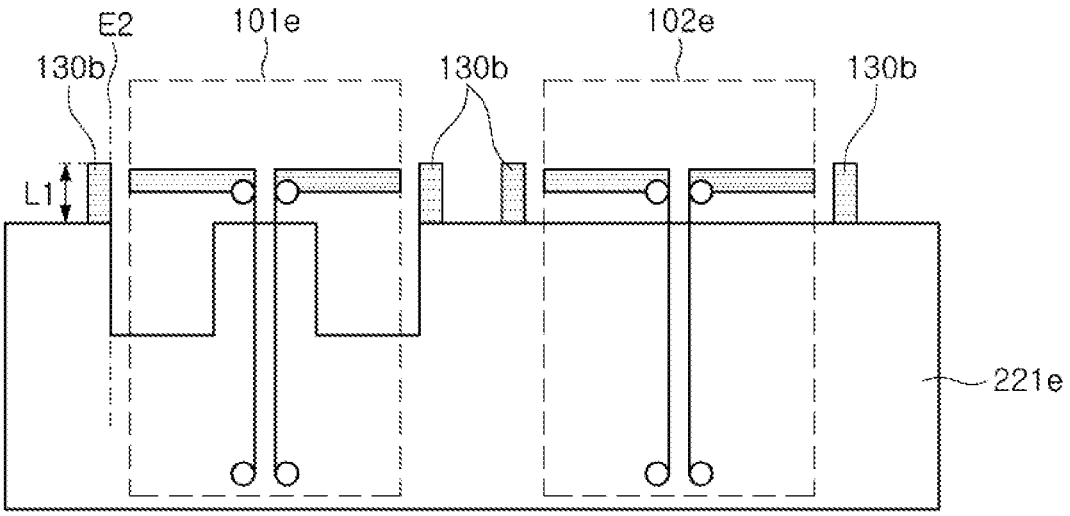
FIGS. 4A to 4G are plan diagrams illustrating various structures of a blocking pattern of an antenna apparatus according to an example embodiment of the present disclosure.
Figure 4B:
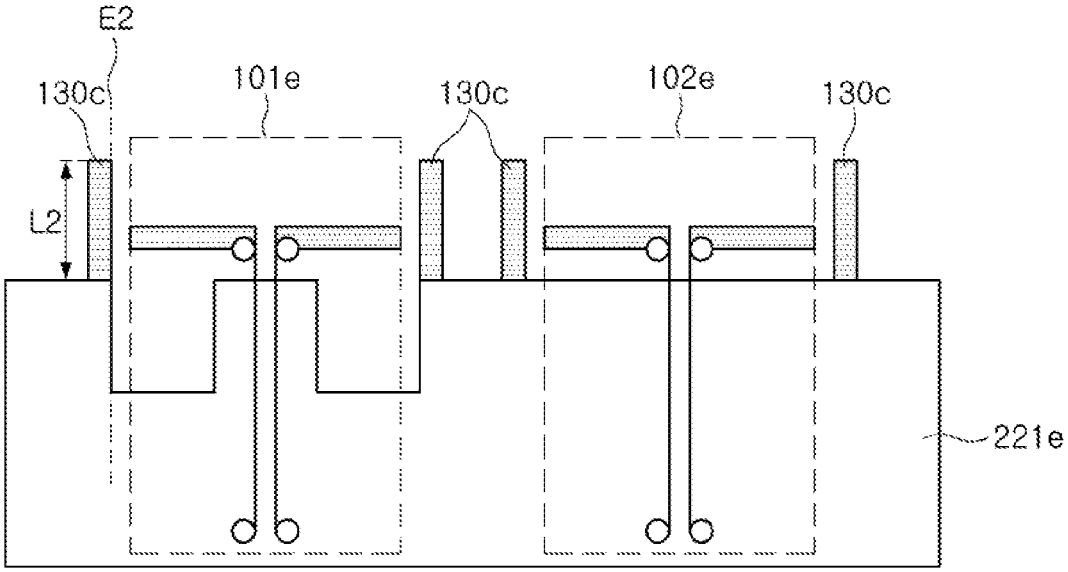
Figure 4C:
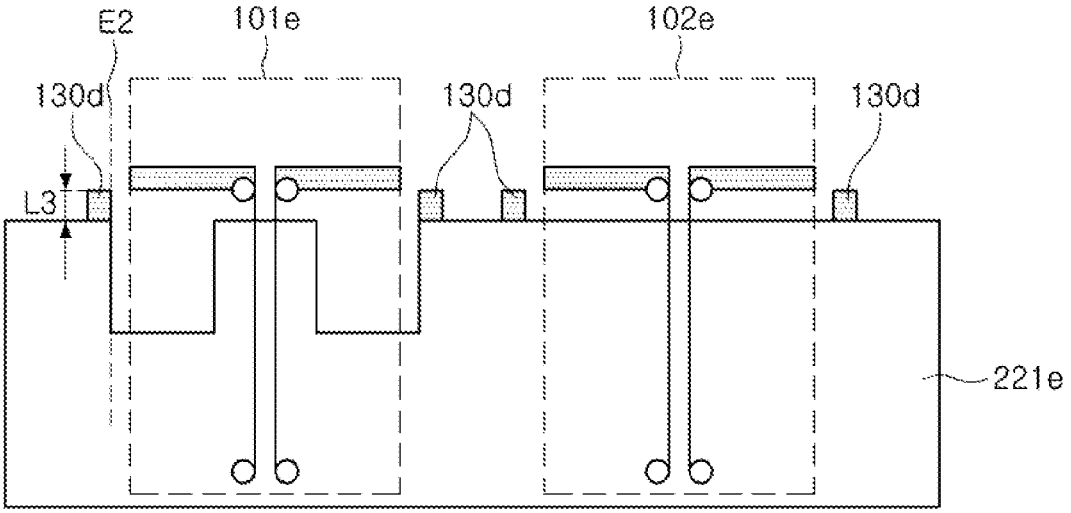

Referring to FIGS. 4A to 4C, a connection member may include a first ground plane 221*e*, and may provide a space in which a plurality of end-fire antennas 101*e* and 102*e* and blocking patterns 130*b*, 130*c*, and 130*d* are disposed. The term "end-fire antennas" 101*e* and 102*e* may include the dipole antenna pattern and the direction pattern described in the aforementioned example embodiments. However, the direction pattern may be omitted from the end-fire antennas 101*e* and 102*e*.

The first ground plane 221*e* may work as a reflector for the plurality of end-fire antennas 101*e* and 102*e*. Depending on the design, an edge of the first ground plane 221*e* may be configured to be recessed. Accordingly, an RF signal reflection efficiency (e.g., a ratio between reinforcement interference and offset interference) of the first ground plane 221*e* may improve, and the plurality of end-fire antennas 101*e* and 102*e* may be disposed more adjacently to the first ground plane 221*e*.

The blocking patterns 130*b*, 130*c*, and 130*d* may be disposed adjacently to the recessed region of the first ground plane 221*e*. Accordingly, the first ground plane 221*e* may have a structure in which the first ground plane 221*e* is organically coupled to the blocking patterns 130*b*, 130*c*, and 130*d*, and thus, an RF signal reflection efficiency may further improve using RF signal reflection performance of the blocking patterns 130*b*, 130*c*, and 130*d*. Also, the plurality of end-fire antennas 101*e* and 102*e* may further be closed to each other as the blocking patterns 130*b*, 130*c*, and 130*d* are adjacently disposed.

Referring to FIG. 4A, the blocking pattern 130*b* may extend adjacently to a position of the dipole antenna pattern of the plurality of end-fire antennas 101*e* and 102*e* taken in a y-direction.

Referring to FIG. 4B, the blocking pattern 130*c* may extend further than the position of the position of the dipole antenna pattern of the plurality of end-fire antennas 101*e* and 102*e* taken in a y-direction. An extended length L2 of the blocking pattern 130*c* may extend to the front by a length corresponding to a region between the plurality of dipole antenna patterns of the plurality of end-fire antennas 101*e* and 102*e* and the plurality of director patterns. The blocking pattern 130*c* may extend to block the space between the plurality of dipole antenna patterns of the plurality of end-fire antennas 101*e* and 102*e*, and to not block the space between the plurality of director patterns. Accordingly, a radial pattern of each of the plurality of end-fire antennas 101*e* and 102*e* may further be concentrated, and thus, a gain and/or directivity of the plurality of end-fire antennas 101*e* and 102*e* may further improve.

Referring to FIG. 4C, the blocking pattern 130*d* may extend less than a portion of the dipole antenna pattern of the plurality of end-fire antennas 101*e* and 102*e* taken in the y-direction.

Figure 4D:
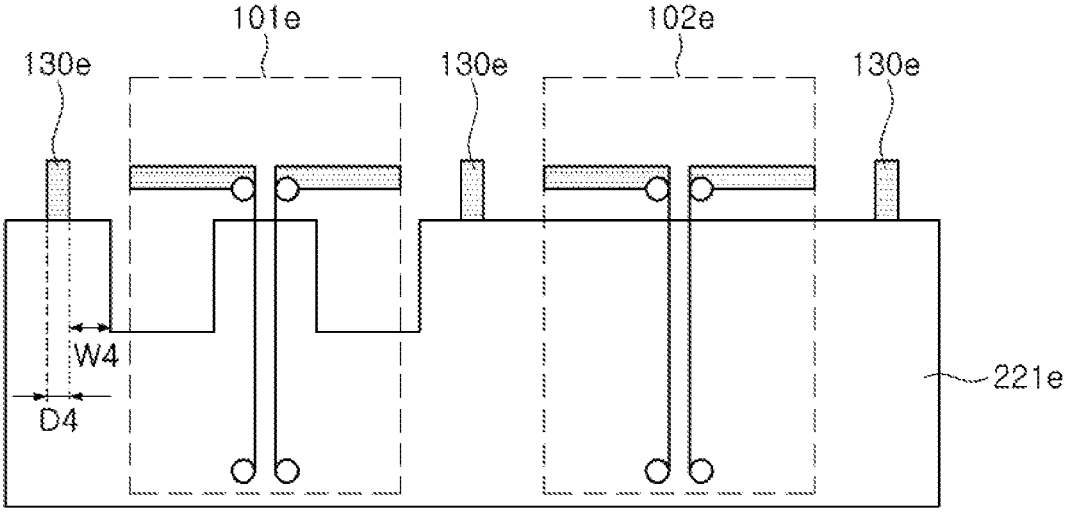

Referring to FIG. 4D, the blocking pattern 130*e* may be spaced apart from the plurality of end-fire antennas 101*e* and 102*e*. The electromagnetic coupling between the plurality of end-fire antennas 101*e* and 102*e* and the blocking pattern 130*e* may be appropriately adjusted in accordance with a separation distance between the blocking pattern 130*e* and the plurality of end-fire antennas 101*e* and 102*e*.

Figure 4E:
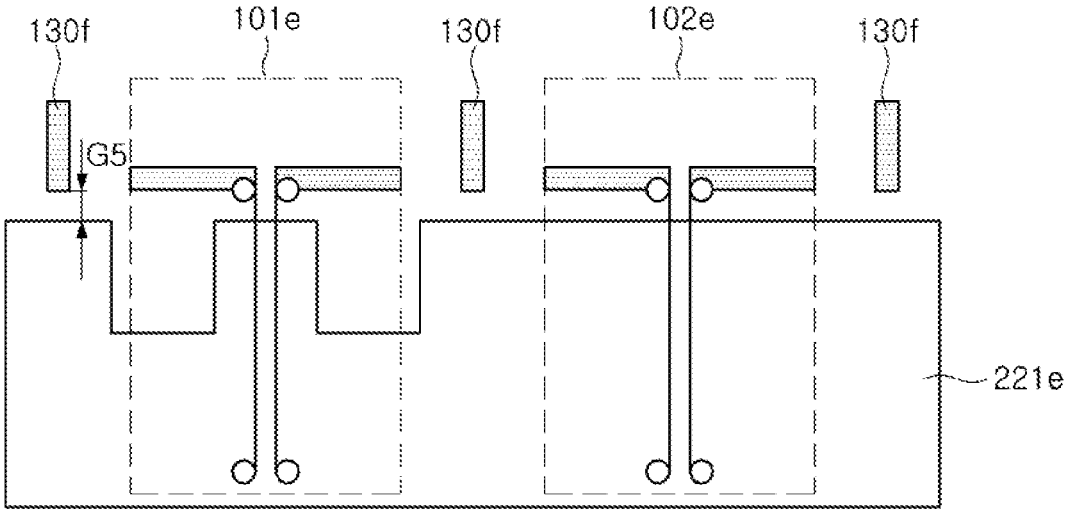

Referring to FIG. 4E, the blocking pattern 130*f* may be spaced apart from the first ground plane 221*e*. Accordingly, the blocking pattern 130*f* may be designed in consideration of electromagnetic coupling between the plurality of end-fire antennas 101*e* and 102*e* and the blocking pattern 130*f*.

Figure 4F:
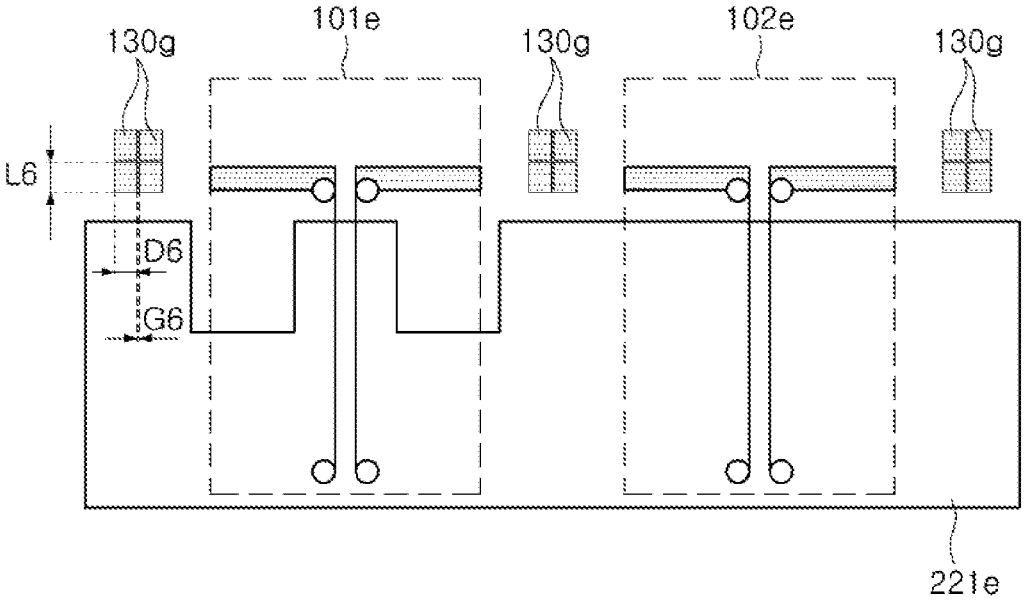

Referring to FIG. 4F, the blocking pattern 130*g* may have a structure in which a plurality of patterns is repeatedly arranged. Accordingly, antenna performance of the plurality of end-fire antennas 101*e* and 102*e* may be designed in accordance with the size of the plurality of patterns, the number of the plurality of patterns, a gap between the plurality of patterns, the number of layers of the plurality of patterns, and the like, and may easily be optimized.

Figure 4G:
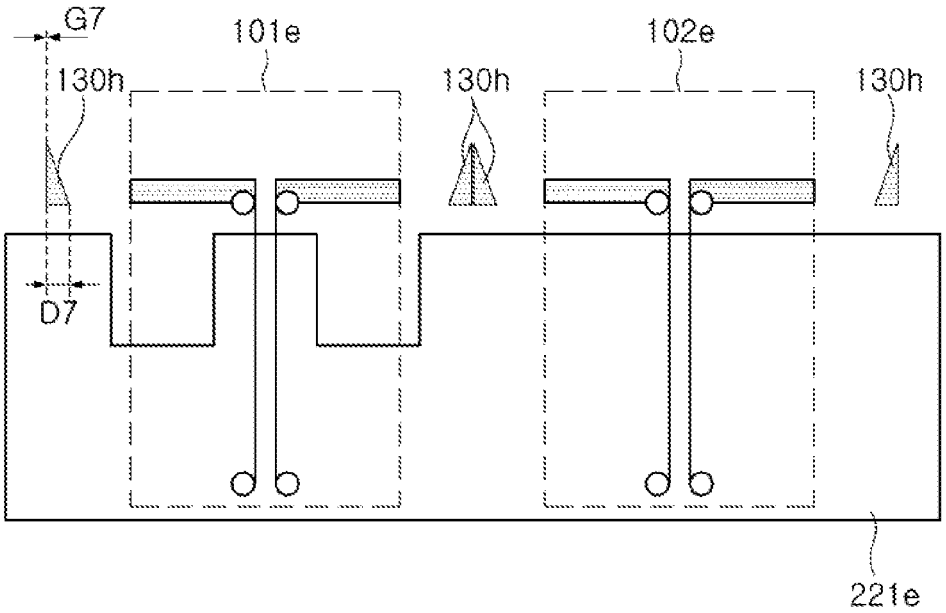

Referring to FIG. 4G, the blocking pattern 130*h* may have a diagonal perimeter in an x-direction and/or a y-direction. Accordingly, the RF signal reflecting the performance of the blocking pattern 130*h* may be adjusted more accurately, and may easily be optimized.

Extended lengths L1, L2, and L3 of the blocking pattern 130*h* may be equal to, or 0.125 times greater or 0.25 times less than a wavelength of an RF signal, but an example embodiment thereof is not limited thereto. Also, a width D4 of the blocking pattern 130*h*, a separation distance W4 between the blocking pattern 130*h* and a cavity, a separation distance G5 of the blocking pattern 130*h* to the first ground plane 221*e*, a length L6 of the plurality of blocking patterns 130*h*, a width D6 and a gap G6, and first and second widths D7 and G7 of the blocking pattern 130*h* may not be limited to any particular size.

FIGS. 5A to 5E are plan diagrams illustrating first to fifth ground planes of an antenna apparatus in order in a z-direction according to an example embodiment.

Figure 5A:
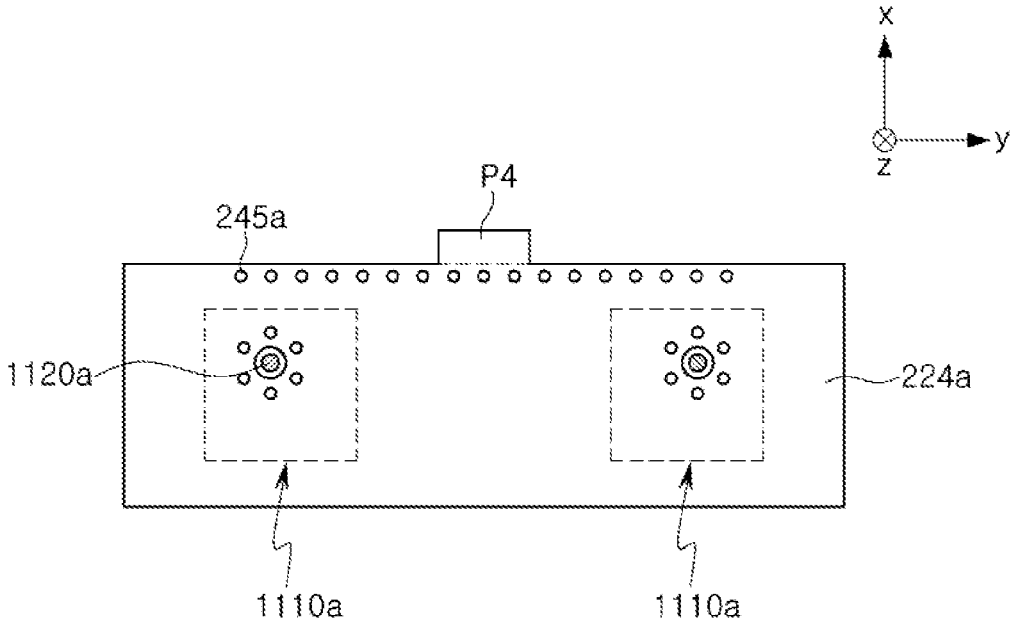
FIGS. 5A to 5E are plan diagrams illustrating first to fifth ground planes of an antenna apparatus in order in a z-direction according to an example embodiment of the present disclosure.

Referring to FIG. 5A, a fourth ground plane 224*a* may be disposed in a lower level of a plurality of patch antenna patterns 1110*a*, may have a plurality of through-holes through which a plurality of second feed vias 1120*a* penetrate, and may include a first protrusion region P4.

The plurality of patch antenna patterns 1110*a* may remotely transfer and/or receive an RF signal in a z-direction. Thus, an antenna apparatus in the example embodiment may transmit and receive RF signals in a horizontal direction through a dipole antenna pattern, and may also transmit and receive RF signals in a vertical direction through the plurality of patch antenna patterns 1110*a*, thereby remotely transmitting and receiving RF signals in all directions.

Figure 5B:
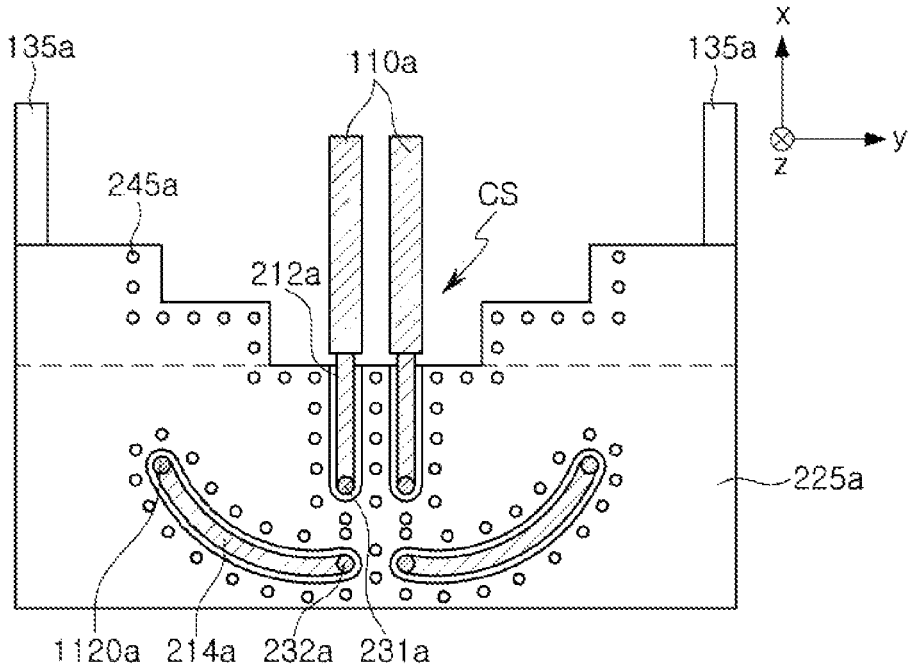

Referring to FIG. 5B, a fifth ground plane 225*a* may be configured to surround a first wiring line 212*a* electrically connecting a feed line 110*a* and a first wiring via 231*a*, and a second wiring line 214*a* electrically connecting a second feed via 1120*a* and a second wiring via 232*a*, and may be connected to a fifth blocking pattern 135*a*.

Figure 5C:
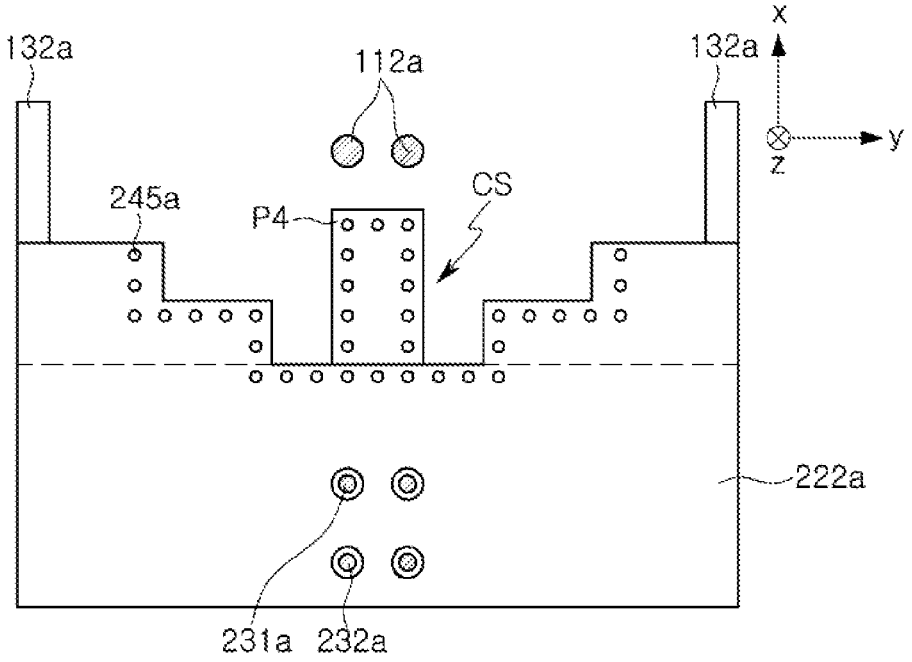

A plurality of shielding vias 245*a* may be arranged along a front perimeter of a staircase contoured cavity CS, and may electrically connect the fifth ground plane 225*a* and a second ground plane 222*a*. Referring to FIG. 5C, the second ground plane 222*a* may include a through-hole through which the first and second wiring vias 231*a* and 232*a* penetrate, and may be connected to a second blocking pattern 132*a*. The plurality of shielding vias 245*a* may be arranged along a front perimeter of the staircase contoured cavity CS, and may electrically connect the second ground plane 222*a* and a first ground plane 221*a*. A via pattern 112*a* may be electrically connected to a dipole antenna pattern.

Figure 5D:
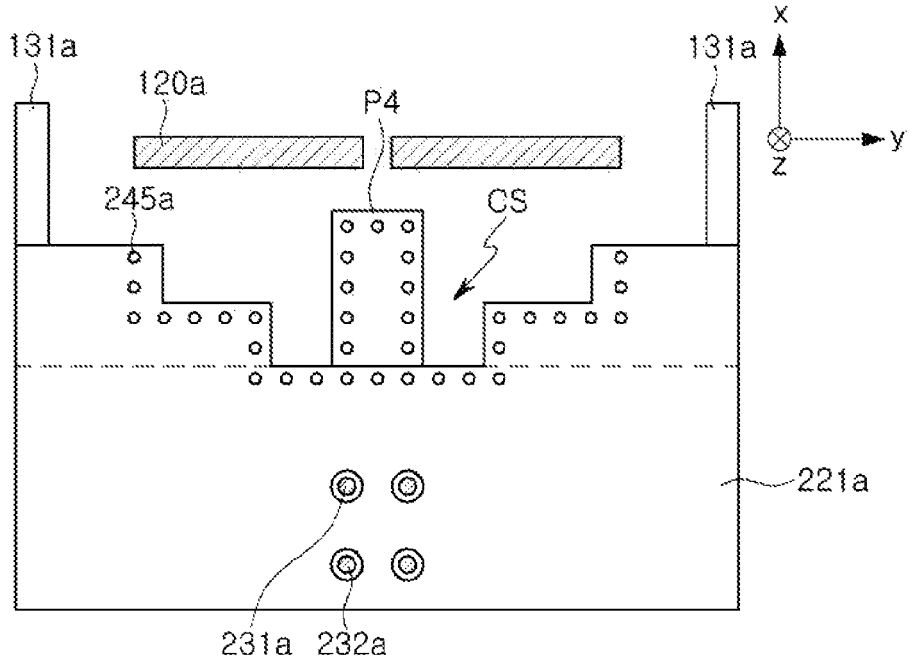

Referring to FIG. 5D, a first ground plane 221*a* may be configured to be recessed into the rear of a dipole antenna pattern 120*a* a number of times, e.g. twice, may include a through-hole through which first and second wiring vias 231*a* and 232*a* penetrate, and may be connected to a first blocking pattern 131*a*. A plurality of shielding vias 245*a* may be arranged along a front perimeter of the staircase contoured cavity CS, and may electrically connect the first ground plane 221*a* and a third ground plane 223*a*. The dipole antenna pattern 120*a* may be disposed in the front (e.g., an x-direction) of the staircase contoured cavity CS.

Figure 5E:
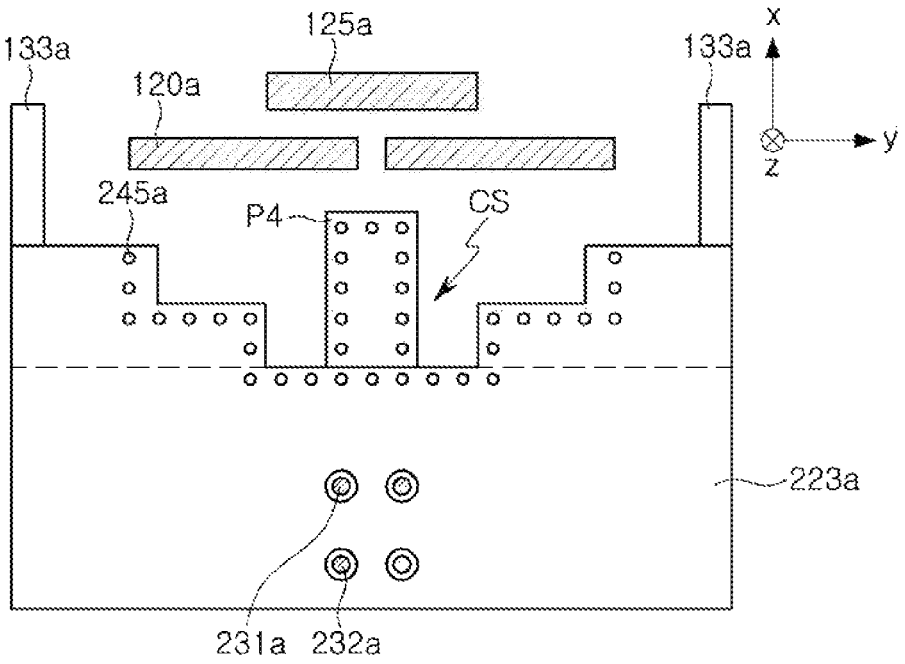

Referring to FIG. 5E, a third ground plane 223*a* may include a through-hole through which first and second wiring vias 231*a* and 232*a* penetrate, and may be connected to a third blocking pattern 133*a*. A dipole antenna pattern 120*a* and a director pattern 125*a* may be disposed in the front (e.g., an x-direction) of a staircase contoured cavity CS.

An overlapping area between the front region of a first ground plane 221*a* and the director pattern 125*a* in the vertical or normal direction (a z-direction) may be filled with an insulating layer. Thus, the number of the layered director patterns 125*a* may be less than the number of the layered dipole antenna patterns 120*a*. Accordingly, a radial pattern of the dipole antenna pattern 120*a* may be more concentrated three-dimensionally, and a gain and/or directivity of the dipole antenna pattern 120*a* may further improve.

As first, second, third, and fifth blocking patterns 131*a*, 132*a*, 133*a*, and 135*a* are disposed to overlap with one another in the vertical or normal direction (a z-direction), a three-dimensional boundary condition may be formed in relation to the dipole antenna pattern 120*a*. Accordingly, the first, second, third, and fifth blocking patterns 131*a*, 132*a*, 133*a*, and 135*a* may effectively isolate the plurality of dipole antenna patterns 120*a* from each other and may improve gains of the plurality of dipole antenna patterns 120*a*. Also, when the dipole antenna patterns 120*a* have a layering structure in a z-direction, the first, second, third, and fifth blocking patterns 131*a*, 132*a*, 133*a*, and 135*a* may increase the size of an electromagnetic coupling surface in relation to the dipole antenna pattern 120*a*, and thus, a design range of a resonance frequency of the dipole antenna pattern 120*a* may be expanded, and a bandwidth may be broadened.

The shielding vias 245*a* may only be arranged on front perimeters of the first to fifth ground planes 221*a*, 222*a*, 223*a*, 224*a*, and 225*a*, rather than being disposed among the first, second, third, and fifth blocking patterns 131*a*, 132*a*, 133*a*, and 135*a*. Thus, spaces between the first, second, third, and fifth blocking patterns 131*a*, 132*a*, 133*a*, and 135*a* may be filled with an insulating layer. Accordingly, the first, second, third, and fifth blocking patterns 131*a*, 132*a*, 133*a*, and 135*a* may provide a three-dimensional boundary condition in relation to the dipole antenna pattern 120*a*, and may effectively emit electromagnetic energy concentrated on the front perimeters of the first to fifth ground planes 221*a*, 222*a*, 223*a*, 224*a*, and 225*a*, thereby improving electromagnetic isolation between the plurality of dipole antenna patterns 120*a*, and also improving electromagnetic isolation between the dipole antenna patterns 120*a* and the patch antenna patterns 1110*a*.

The higher the number of the ground planes providing a cavity among the first to fifth ground planes 221*a*, 222*a*, 223*a*, 224*a*, and 225*a*, the longer the length of the cavity taken in the vertical or normal direction (a z-direction). The length of the cavity taken in the vertical or normal direction (a z-direction) may affect antenna performance of the dipole antenna pattern 120*a*. The antenna apparatus in the example embodiment may easily adjust the length of the cavity taken in the vertical or normal direction (a z-direction) by adjusting the number of the ground planes providing the cavity, and thus, antenna performance of the dipole antenna pattern 120*a* may easily be adjusted.

Recessed regions of at least two of the first to fifth ground planes 221*a*, 222*a*, 223*a*, 224*a*, and 225*a* may have the same rectangular shape. Accordingly, the cavity may have a rectangular parallelepiped shape. When the cavity has a rectangular parallelepiped shape, a ratio of an x vector component to a y vector component of an RF signal may increase. A y vector component may easily be offset in the cavity as compared to an x vector component, and thus, the higher the ratio of an x vector component of an RF signal reflected from a boundary of the cavity, the more improved gain the dipole antenna pattern 120*a* may have. Thus, the more similar to the parallelopipedon the cavity is, the more improved gain the dipole antenna pattern 120*a* may have.

Figure 6:
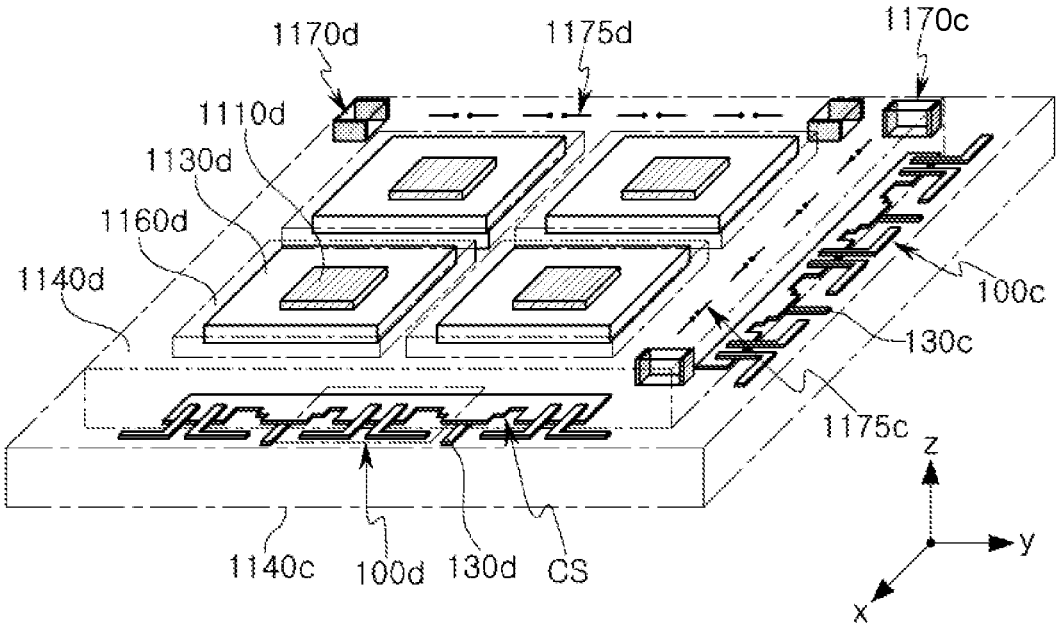
FIG. 6 is a perspective diagram illustrating an arrangement of antenna apparatuses illustrated in FIGS. 1A to 5E.

FIG. 6 is a perspective diagram illustrating an arrangement of antenna apparatuses illustrated in FIGS. 1A to 5E.

Referring to FIG. 6, an antenna apparatus in the example embodiment may include a plurality of antenna apparatuses 100*c* and 100*d*, a plurality of patch antenna patterns 1110*d*, a plurality of patch antenna cavities 1130*d*, dielectric layers 1140*c* and 1140*d*, a plating member 1160*d*, a plurality of chip antennas 1170*c* and 1170*d*, and a plurality of dipole antennas 1175*c* and 1175*d*.

The plurality of antenna apparatuses 100*c* and 100*d* may be designed similarly to the antenna apparatus described with reference to FIGS. 1A to 5E, and may be disposed adjacently to side surfaces of an antenna module and may be arranged in parallel to each other. Accordingly, a portion of the plurality of antenna apparatuses 100*c* and 100*d* may transmit and receive RF signals in an x-axis direction, and the other antenna apparatus may transmit and receive RF signals in a y-axis direction.

The plurality of patch antenna patterns 1110*d* may be disposed adjacently to an upper level of the antenna module, and may transmit and receive RF signals in the vertical or normal direction (a z-direction). The number and an arrangement of the plurality of patch antenna patterns 1110*d* may not be limited to any particular number and an arrangement. For example, the plurality of patch antenna patterns 1110*d* may have a circular form, and may be arranged in a structure of 1×n (n is a natural number equal to or greater than 2), and the number of the plurality of patch antenna patterns may be 16.

The plurality of patch antenna cavities 1130*d* each may be configured to cover side surfaces and a lower level of each of the plurality of patch antenna patterns 1110*d*, and may provide a boundary condition for each of the plurality of patch antenna patterns 1110*d* to transmit and receive RF signals.

The plurality of chip antennas 1170*c* and 1170*d* may have two electrodes opposing each other, may be disposed in an upper level or a lower level of an antenna module, and may be disposed to transmit and receive RF signals in an x-axis direction and/or a y-axis direction through one of the two electrodes.

The plurality of dipole antennas 1175*c* and 1175*d* may be disposed in an upper level or in a lower level of the antenna module, and may transmit and receive RF signals in a z-axis direction. Thus, the plurality of dipole antennas 1175*c* and 1175*d* may be disposed perpendicularly to the plurality of antenna apparatuses 100*c* and 100*d* in the vertical or normal direction (a z-direction).

Figure 7A:
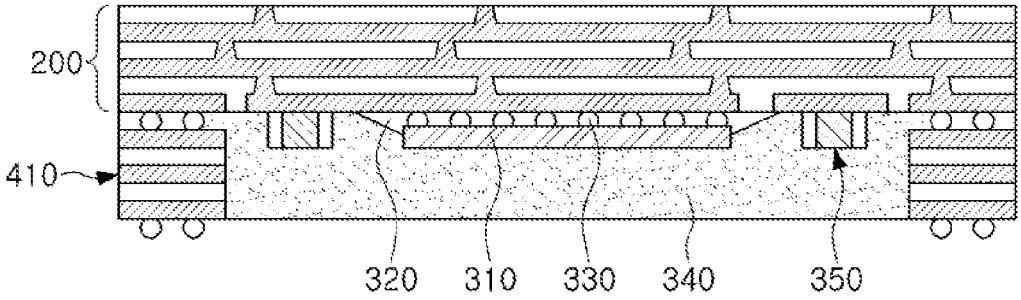
FIGS. 7A and 7B are diagrams illustrating a structure of a lower level of a connection member which may be included in antenna apparatuses illustrated in FIGS. 1A to 5E.
Figure 7B:
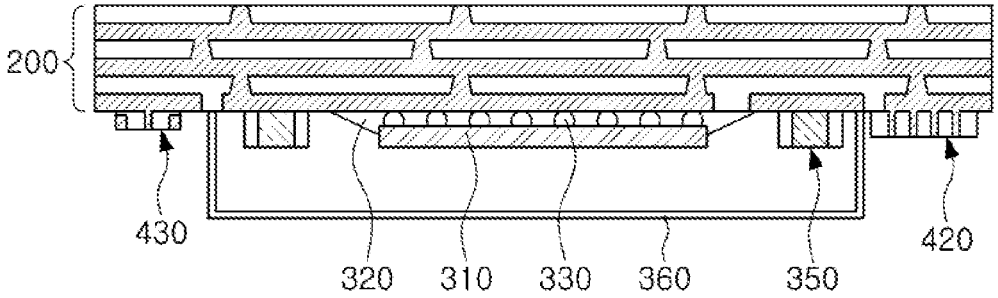

FIGS. 7A and 7B are diagrams illustrating a structure of a lower level of a connection member which may be included in antenna apparatuses illustrated in FIGS. 1A to 5E.

Referring to FIG. 7A, an antenna apparatus in the example embodiment may include at least portions of a connection member 200, an IC 310, an adhesive member 320, an electrical connection structure 330, an encapsulant 340, a passive component 350, and a sub-substrate 410.

The connection member 200 may have a structure similar to a structure of a connection member described with reference to FIGS. 1 to 8.

The IC 310 may be the same as the IC described in the aforementioned example embodiment, and may be disposed in a lower level of the connection member 200. The IC 310 may be electrically connected to a wiring line of the connection member 200 and may transmit or receive RF signals, and may be electrically connected to a ground plane of the connection member 200 and may be provided with a ground. For example, the IC 310 may perform at least portions of operations among a frequency conversion, an amplification, a filtering, a phase control, and a power generation, thereby generating a converted signal.

The adhesive member 320 may cause the IC 310 to be bonded to the connection member 200.

The electrical connection structure 330 may electrically connect the IC 310 to the connection member 200. For example, the electrical connection structure 330 may have a structure, such as a solder ball, a pin, a land, or a pad. The electrical connection structure 330 may have a melting point lower than melting points of a wiring line of the connection member 200 and the ground plane, and may electrically connect the IC 310 to the connection member 200 through a certain process using a low melting point.

The encapsulant 340 may encapsulate at least a portion of the IC 310, and may improve heat radiation performance and shock protection performance. For example, the encapsulant 340 may be implemented as a photo-imageable encapsulant (PIE), an Ajinomoto build-up film (ABF), an epoxy molding compound (EMC), and the like.

The passive component 350 may be disposed on a lower surface of the connection member 200, and may be electrically connected to a wiring line and/or a ground plane of the connection member 200 through the electrical connection structure 330.

The sub-substrate 410 may be disposed in a lower level of the connection member 200, and may be electrically connected to the connection member 200 to receive an intermediate frequency (IF) signal or a base band signal from an external entity and transfer the signal to the IC 310, or to receive an IF signal or a base band signal from the IC 310 and transfer the signal to an external entity. A frequency of an RF signal (e.g., 24 GHz, 28 GHz, 36 GHz, 39 GHz, and 60 GHz) may be greater than a frequency of an IF signal (e.g., 2 GHz, 5 GHz, 10 GHz, and the like).

For example, the sub-substrate 410 may transfer an IF signal or a base band signal to the IC 310 or may receive an IF signal or a base band signal from the IC 310 via a wiring line included in an IC ground plane of the connection member 200. As a first ground plane of the connection member 200 is disposed between the IC ground plane and the wiring line, an IF signal or a base band signal and an RF signal may be electrically isolated from each other in an antenna module.

Referring to FIG. 7B, an antenna apparatus in the example embodiment may include at least portions of a shielding member 360, a connector 420, and a chip antenna 430.

The shielding member 360 may be disposed in a lower level of the connection member 200 and may shield the IC 310 together with the connection member 200. For example, the shielding member 360 may cover or conformally shield the IC 310 and a passive component 350 together, or may cover or shield the IC 310 and a passive component 350 individually in compartment form. For example, the shielding member 360 may have a hexahedron shape in which one surface is opened, and may have a hexahedral receiving space by being coupled to the connection member 200. The shielding member 360 may be implemented by a material having high conductivity such as copper and may have a relatively short skin depth, and may be electrically connected to a ground plane of the connection member 200. Thus, the shielding member 360 may reduce electromagnetic noise which the IC 310 and the passive component 350 may receive.

The connector 420 may have a connection structure of a cable (e.g., a coaxial cable, a flexible PCB, and the like), may be electrically connected to an IC ground plane of the connection member 200, and may work similarly to the sub-substrate described in the aforementioned example embodiment. Thus, the connector 420 may receive an IF signal, a base band signal and/or power from a cable, or may provide an IF signal and/or a base band signal to a cable.

The chip antenna 430 may transmit or receive an RF signal as an auxiliary element of the antenna apparatus in the example embodiment. For example, the chip antenna 430 may include a dielectric block having a dielectric constant greater than a dielectric constant of an insulating layer, and a plurality of electrodes disposed on both surfaces of the dielectric block. One of the plurality of electrodes may be electrically connected to a wiring line of the connection member 200, and the other may be electrically connected to a ground plane of the connection member 200.

Figure 8:
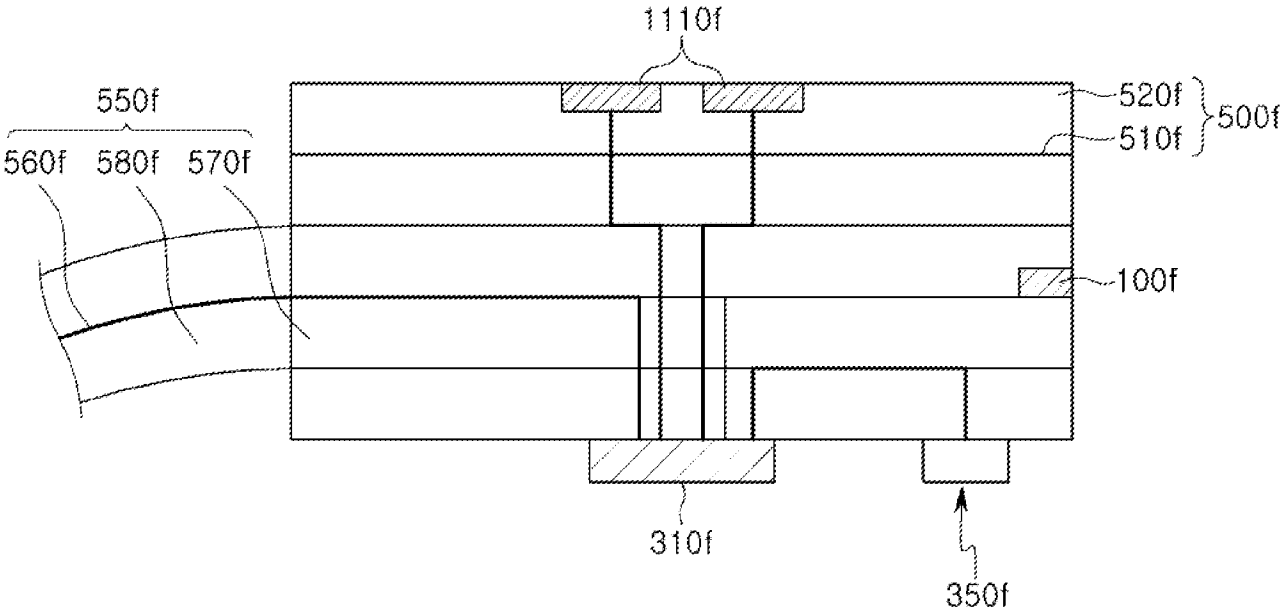
FIG. 8 is a lateral view of a rigid-flexible structure implementable in antenna apparatuses illustrated in FIGS. 1A to 5E.

FIG. 8 is a lateral view of a rigid-flexible structure implementable in antenna apparatuses illustrated in FIGS. 1A to 5E.

Referring to FIG. 8, an antenna apparatus 100*f* may have a structure in which a patch antenna pattern 1110*f*, an IC 310*f*, and a passive component 350*f* are integrated into a connection member 500*f*.

The antenna apparatus 100*f* and the patch antenna pattern 1110*f* may be configured to be the same as the antenna apparatus and the patch antenna pattern described in the aforementioned example embodiment, and may receive an RF signal from the IC 310 and transmit the received signal, or may transmit the received RF signal to the IC 310.

The connection member 500*f* may have a structure (e.g., a structure of a printed circuit board) in which at least one conductive layer 510*f* and at least one insulating layer 520*f* are layered. The conductive layer 510*f* may have the ground plane and the wiring line described in the aforementioned example embodiment.

The antenna apparatus in the example embodiment may further include a flexible connection member 550*f*. The flexible connection member 550*f* may include a first flexible region 570*f* overlapping the connection member 500*f*, and a second flexible region 580*f* which does not overlap the connection member 500*f*, in the vertical or normal direction.

The second flexible region 580*f* may be flexibly bent in the vertical or normal direction. Accordingly, the second flexible region 580*f* may be flexibly connected to a connector on a set substrate and/or an adjacent antenna module.

The flexible connection member 550*f* may include a signal line 560*f*. An intermediate frequency (IF) signal and/or a base band signal may be transferred to the IC 310*f* via the signal line 560*f*, or may be transferred to a connector on a set substrate and/or an adjacent antenna module.

Figure 9A:
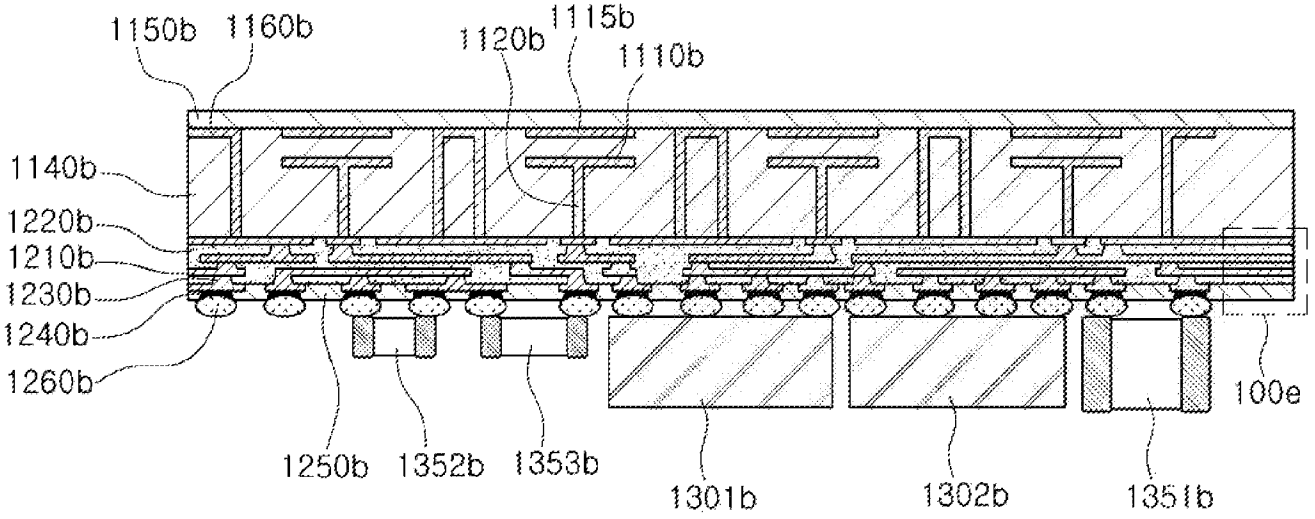
FIGS. 9A and 9B are lateral views of an example of an antenna package and an example of an IC package which may be included in antenna apparatuses illustrated in FIGS. 1A to 5E.
Figure 9B:
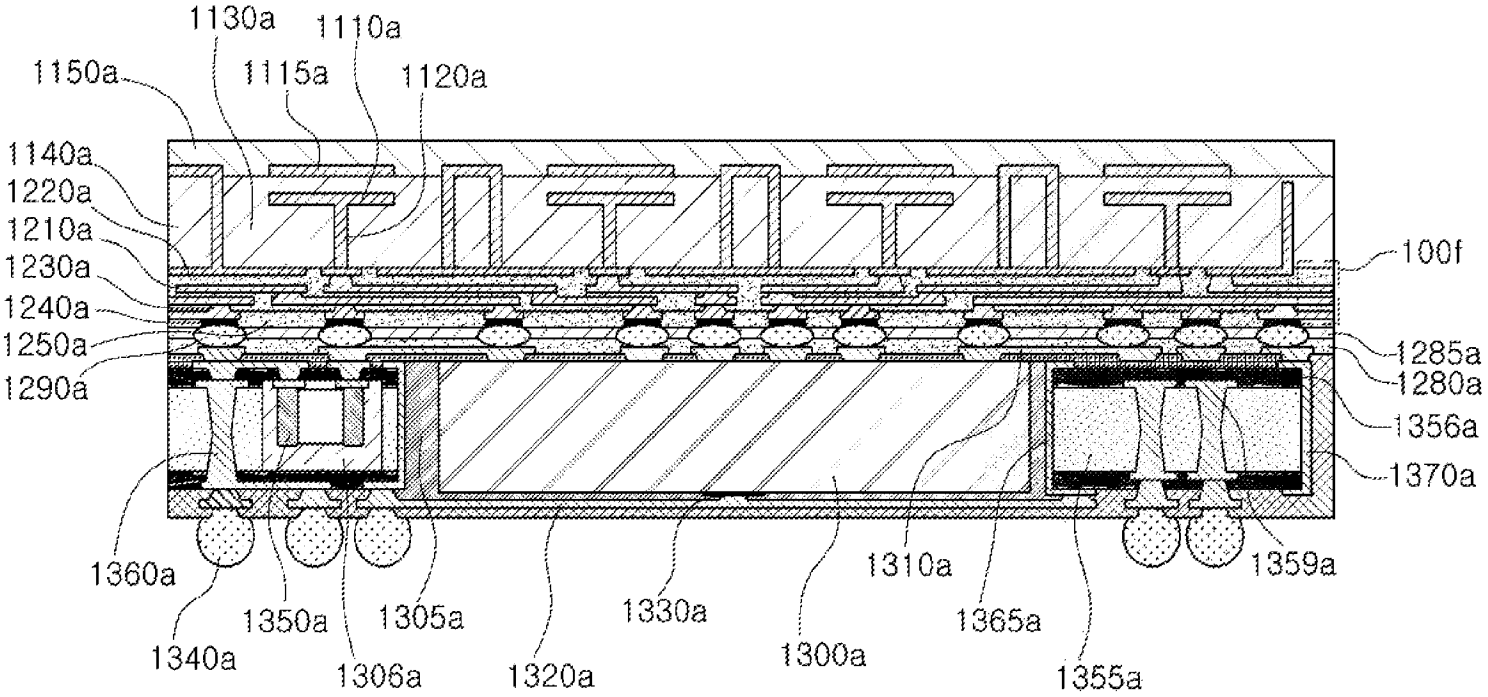

FIGS. 9A and 9B are lateral views of an example of an antenna package and an example of an IC package which may be included in antenna apparatuses illustrated in FIGS. 1A to 5E.

Referring to FIG. 9A, an antenna apparatus in the example embodiment may have a structure in which an antenna package and a connection member are coupled to each other.

The connection member may include at least one conductive layer 1210*b*, and at least one insulating layer 1220*b*, and may further include a wiring via 1230*b* connected to the at least one conductive layer 1210*b*, and a connection pad 1240*b* connected to the wiring via 1230*b*. The connection member may have a structure similar to a structure of a copper redistribution layer (RDL). An antenna package may be disposed on an upper surface of the connection member.

The antenna package may include at least portions of a plurality of patch antenna patterns 1110*b*, a plurality of upper coupling patterns 1115*b*, a plurality of second feed vias 1120*b*, a dielectric layer 1140*b*, and an encapsulation member 1150*b*.

One ends of the plurality of second feed vias 1120*b* may be electrically connected to the plurality of patch antenna patterns 1110*b*, and the other ends of the plurality of second feed vias 1120*b* may be electrically connected to wiring lines corresponding to at least one conductive layer 1210*b* of the connection member, respectively.

The dielectric layer 1140*b* may be disposed to surround side surfaces of each of the plurality of feed vias 1120*b*. The dielectric layer 1140*b* may have a height higher than a height of at least one of the insulating layers 1220*b* of the connection member. The greater the height and/or width of the dielectric layer 1140*b*, the more likely the antenna package may achieve antenna performance, and boundary conditions (e.g., a reduced manufacturing tolerance, a shorter electrical length, a smooth surface, an increased size of a dielectric layer, adjacent of a dielectric constant, and the like) for transmission and reception of RF signals of a plurality of dipole antenna patterns 1115*b* may be provided.

The encapsulation member 1150*b* may be disposed on the dielectric layer 1140*b*, and may improve the durability of the plurality of patch antenna patterns 1110*b* and/or the plurality of upper coupling patterns 1115*b* against shocks or oxidation. For example, the encapsulation member 1150*b* may be implemented as a photo-imageable encapsulant (PIE), an Ajinomoto build-up film (ABF), an epoxy molding compound (EMC), and the like, but an example embodiment thereof is not limited thereto.

An IC 1301*b*, a PMIC 1302*b*, and a plurality of passive components 1351*b*, 1352*b*, and 1353*b* may be disposed on a lower surface of a connection member.

The PMIC 1302*b* may generate power, and may transfer the generated power to the IC 1301*b* through at least one conductive layer 1210*b* of the connection member.

The plurality of passive components 1351*b*, 1352*b*, and 1353*b* may provide an impedance to the IC 1301*b* and/or the PMIC 1302*b*. For example, the plurality of passive components 1351*b*, 1352*b*, and 1353*b* may include at least portions of a capacitor (e.g., a multilayer ceramic capacitor (MLCC)), and inductor, or a chip resistor.

Referring to FIG. 9B, an IC package may include an IC 1300*a*, an encapsulant 1305*a* encapsulating at least a portion of the IC 1300*a*, a support member 1355*a* of which a first side surface may be configured to oppose the IC 1300*a*, at least one conductive layer 1310*a* electrically connected to the IC 1300*a* and the support member 1355*a*, and a connection member including an insulting layer 1280*a*, and may be coupled to the connection member or an antenna package.

The connection member may include at least one conductive layer 1210*a*, at least one insulating layer 1220*a*, a wiring via 1230*a*, a connection pad 1240*a*, and a passivation layer 1250*a*. The antenna package may include a plurality of patch antenna patterns 1110*a*, 1110*b*, 1110*c*, and 1110*d*, a plurality of upper coupling patterns 1115*a*, 1115*b*, 1115*c*, and 1115*d*, a plurality of second feed vias 1120*a*, 1120*b*, 1120*c*, and 1120*d*, a dielectric layer 1140*a*, and an encapsulation member 1150*a*.

The IC package may be coupled to the connection member. An RF signal generated in the IC 1300*a* included in the IC package may be transferred to the antenna package through at least one conductive layer 1310*a* and may be transmitted towards an upper surface of the antenna module, and the RF signal received in the antenna package may be transferred to the IC 1300*a* through at least one conductive layer 1310*a*.

The IC package may further include a connection pad 1330*a* disposed on an upper surface and/or a lower surface of the IC 1300*a*. The connection pad disposed on the upper surface of the IC 1300*a* may be electrically connected to at least one conductive layer 1310*a*, and the connection pad disposed on a lower surface of the IC 1300*a* may be electrically connected to a support member 1355*a* or a core plating member 1365*a* through a lower conductive layer 1320*a*. The core plating member 1365*a* may provide a ground region to the IC 1300*a*.

The support member 1355*a* may include a core dielectric layer 1356*a* being in contact with the connection member, a core conductive layer 1359*a* disposed on an upper surface and/or a lower surface of the core dielectric layer 1356*a*, and at least one core via 1360*a* penetrating the core dielectric layer 1356*a*, electrically connecting the core conductive layers 1359*a*, and electrically connected to the connection pad 1330*a*. The at least one core via 1360*a* may be electrically connected to an electrical connection structure 1340*a*, such as a solder ball, a pin, and a land.

Accordingly, the support member 1355*a* may be supplied with a base signal or power from a lower surface and may transfer the base signal and/or power to the IC 1300*a* through at least one conductive layer 1310*a* of the connection member.

The IC 1300*a* may generate an RF signal of an mmWave band using the base signal and/or power. For example, the IC 1300*a* may receive the base signal of a low frequency, and may perform conversion and amplification of a frequency of the base signal, a filtering phase control, and power generation, and may be implemented as a compound semiconductor (e.g., GaAs) or may be implemented as a silicon semiconductor in consideration of frequency properties.

The IC package may further include a passive component 1350*a* electrically connected to a wiring line corresponding to at least one conductive layer 1310*a*. The passive component 1350*a* may be disposed in a receiving space 1306*a* provided by the support member 1355*a*.

The IC package may include core plating members 1365*a*, and 1370*a* disposed on side surfaces of the support member 1355*a*. The core plating members 1365*a* and 1370*a* may provide a ground region to the IC 1300*a*, and may radiate heat of the IC 1300*a* to the outside or may remove the noise of the IC 1300*a*.

The IC package and the connection member may be manufactured independently and coupled to each other, but may also be manufactured together depending on design. A process of coupling a plurality of packages may be omitted.

The IC package may be coupled to the connection member through an electrical connection structure 1290*a* and a passivation layer 1285*a*, but the electrical connection structure 1290*a* and the passivation layer 1285*a* may be omitted depending on design.

Figure 10A:
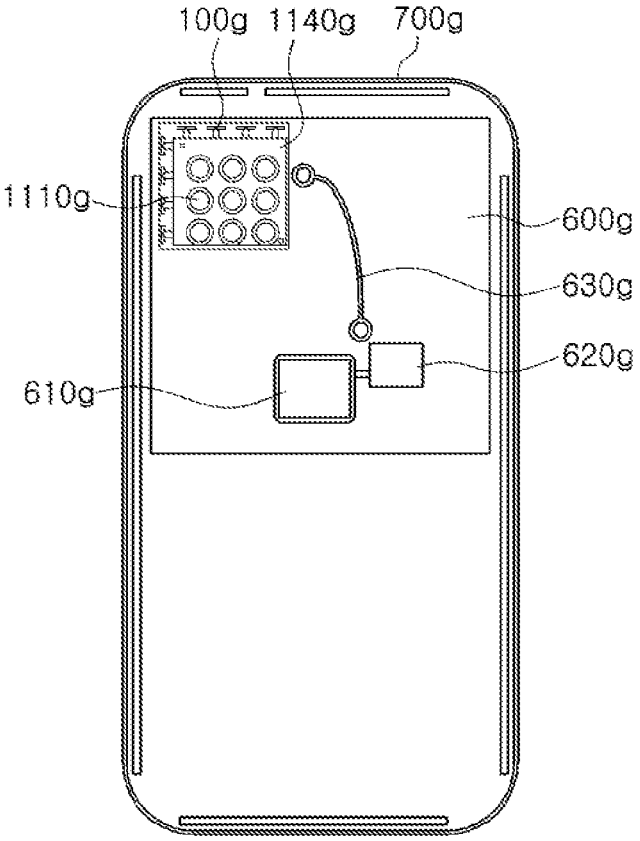

FIGS. 10A to 100 are plan diagrams illustrating an arrangement of antenna apparatuses in an electronic device according to an example embodiment.

Referring to FIG. 10A, an antenna module including an antenna apparatus 100*g*, a patch antenna pattern 1110*g*, and a dielectric layer 1140*g* may be disposed adjacently to a side boundary of an electronic device 700*g* on a set substrate 600*g* of the electronic device 700*g*.

The electronic device 700*g* may be implemented as a smart phone, a personal digital assistant, a digital video camera, a digital still camera, a network system, a computer, a monitor, a tablet, a laptop, a netbook, a television, a video game, a smart watch, an Automotive, and the like, but an example embodiment thereof is not limited thereto.

A communication module 610*g* and a baseband circuit 620*g* may further be disposed on the set substrate 600*g*. The antenna module may be electrically connected to the communication module 610*g* and/or the baseband circuit 620*g* through a coaxial cable 630*g*.

The communication module 610*g* may include at least portions of a memory chip such as a volatile memory (e.g., a DRAM), a non-volatile memory (e.g., an ROM), a flask memory, and the like; an application processor chip such as a central processor (e.g., a CPU), a graphic process (e.g., a GPU), a digital signal processor, a crypto processor, a micro processor, a micro controller, and the like, a logic chip such as an analog-to-digital converter, an application-specific IC (ASIC), and the like.

The baseband circuit 620*g* may generate a base signal by performing an analogue to digital conversion, an amplification of an analogue signal, a filtering, and a frequency conversion. A base signal input to and output from the baseband circuit 620*g* may be transferred to the antenna module through via a cable.

For example, the base signal may be transferred to an IC via an electrical connection structure, a core via, and a wiring line. The IC may convert the base signal into an RF signal of an mmWave band.

Figure 10B:
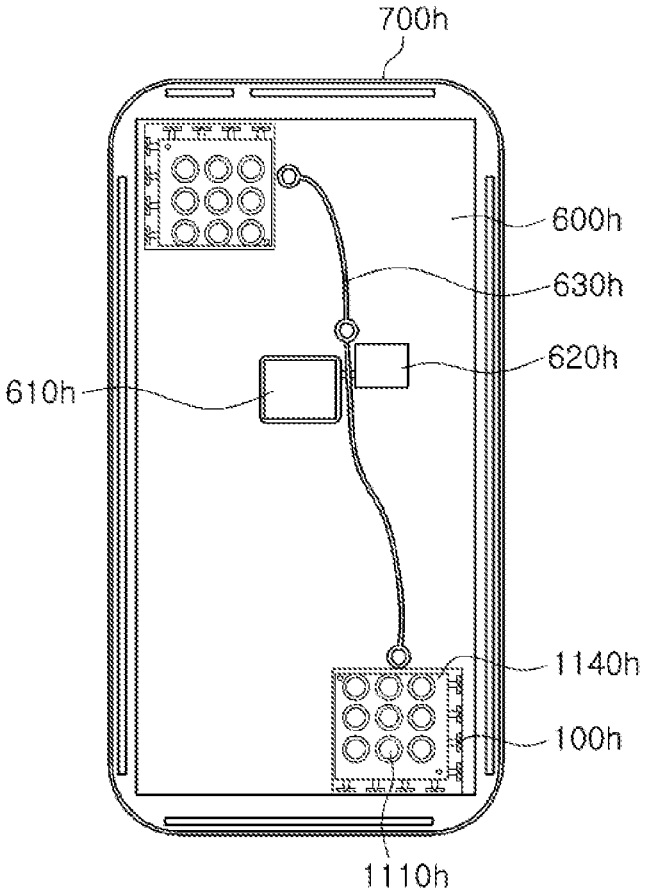
Figure 10C:
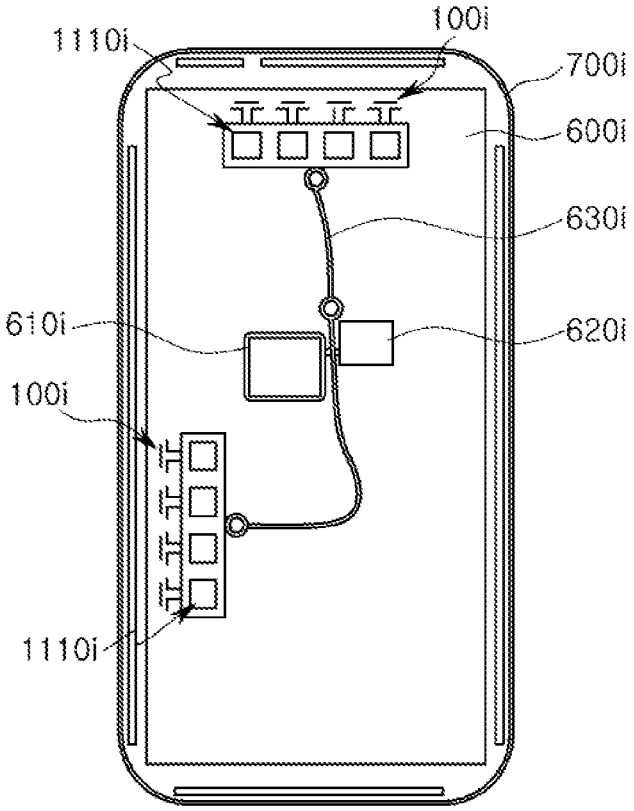

Referring to FIG. 10B, a plurality of antenna modules each including an antenna apparatus 100*h*, a patch antenna pattern 1110*h*, and a dielectric layer 1140*h* may be disposed adjacently to a boundary on one side surface and a boundary on the other side surface of an electronic device 700*h* on a set substrate 600*h* of the electronic device 700*h*, and a communication module 610*h* and a baseband circuit 620*h* may further be disposed on the set substrate 600*h*. The plurality of antenna modules may be electrically connected to the communication module 610*h* and/or the baseband circuit 620*h* via a coaxial cable 630*h*.

Referring to FIG. 100, a plurality of antenna modules each including an antenna apparatus 100*i* and a patch antenna pattern 1110*i* may be disposed adjacently to centers of sides of a polygonal electronic device 700*i* on a set substrate 600*i*, and a communication module 610*i* and a baseband circuit 620*i* may further be disposed on the set substrate 600*i*. The antenna apparatus and the antenna module may be electrically connected to the communication module 610*i* and/or the baseband circuit 620*i* through a coaxial cable 630*i*.

According to the aforementioned example embodiments, the antenna apparatus may improve antenna performance (a transmission and reception rate, a gain, a bandwidth, directivity, and the like) using a blocking pattern, or may have an easily miniaturized structure.

In the example embodiments, conductive layers, ground planes, feed lines, feed vias, dipole antenna patterns, patch antenna patterns, shielding vias, director patterns, electrical connection structures, plating members, core vias, and blocking patterns may include a metal material (e.g., conductive materials such as copper (Cu), aluminum (Al), silver (Ag), tin (Sn), gold (Au), nickel (Ni), lead (Pb), titanium (Ti), or alloys thereof), and may be formed by a plating method such as a chemical vapor deposition (CVD), a physical vapor deposition (PVD), a sputtering process, a subtractive process, an additive process, a semi-additive process, a modified semi-additive process (MSAP), and the like, but the material and the method are not limited thereto.

The dielectric layer and/or the insulating layer described in the aforementioned example embodiments may be a thermosetting resin such as an FR4, a liquid crystal polymer (LCP), a low temperature co-fired ceramic (LTCC), and an epoxy resin, a thermoplastic resin such as a polyimide resin, a resin in which the thermosetting resin or the thermoplastic resin is mixed with an inorganic filler or is impregnated together with an inorganic filler in a core material such as a glass fiber (a glass fiber, a glass cloth, and a glass fabric), prepreg, Ajinomoto build-up film (ABF), FR-4, bismaleimide triazine (BT), a photo-imagable dielectric (PID) resin, a copper clad laminate (CCL), a glass or ceramic based insulating material, or the like. The insulating layer may fill at least a portion of a position in the antenna apparatus described in example embodiments in which a conductive layer, a ground plane, a feed line, a feed via, a dipole antenna pattern, a patch antenna pattern, a shielding via, a director pattern, an electrical connection structure, a plating member, a core via, and a blocking pattern are not disposed.

An RF signal described in the aforementioned example embodiments may have a form based on W-Fi (IEEE 802.11 family, and the like), WiMAX (IEEE 802.16 family, and the like), IEEE 802.20, LTE (long term evolution), Ev-DO, HSPA+, HSDPA+, HSUPA+, EDGE, GSM, GPS, GPRS, CDMA, TDMA, DECT, Bluetooth, 3G, 4G, 5G, and other latest random wireless and wired protocols, but an example embodiment thereof is not limited thereto.

As a non-exhaustive example only, an electronic device as described herein may be a mobile device, such as a cellular phone, a smart phone, a wearable smart device (such as a ring, a watch, a pair of glasses, a bracelet, an ankle bracelet, a belt, a necklace, an earring, a headband, a helmet, or a device embedded in clothing), a portable personal computer (PC) (such as a laptop, a notebook, a subnotebook, a netbook, or an ultra-mobile PC (UMPC), a tablet PC (tablet), a phablet, a personal digital assistant (PDA), a digital camera, a portable game console, an MP3 player, a portable/personal multimedia player (PMP), a handheld e-book, a global positioning system (GPS) navigation device, or a sensor, or a stationary device, such as a desktop PC, a high-definition television (HDTV), a DVD player, a Blu-ray player, a set-top box, or a home appliance, or any other mobile or stationary device configured to perform wireless or network communication. In one example, a wearable device is a device that is designed to be mountable directly on the body of the user, such as a pair of glasses or a bracelet. In another example, a wearable device is any device that is mounted on the body of the user using an attaching device, such as a smart phone or a tablet attached to the arm of a user using an armband, or hung around the neck of the user using a lanyard.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

first dipole antenna patterns;

feed lines connected to corresponding ones of the first dipole antenna patterns;

a first ground plane disposed on a side of the first dipole antenna patterns and spaced apart from each of the first dipole antenna patterns; and a first blocking pattern comprising a number of first subpatterns, and disposed on a side of the first ground plane facing the first dipole antenna patterns between adjacent ones of the first dipole antenna patterns, wherein a width of one end of the first blocking pattern is smaller than a width of another end of the first blocking pattern.

2. The antenna apparatus of claim 1, wherein the number of first subpatterns is four, and the four first subpatterns are arranged two-dimensionally.

3. The antenna apparatus of claim 2, further comprising a second blocking pattern comprising four second subpatterns arranged two-dimensionally, and disposed between adjacent ones of the first dipole antenna patterns on an upper side of the first blocking pattern, wherein the four second subpatterns are disposed to vertically overlap with the four first subpatterns.

4. The antenna apparatus of claim 3, further comprising a third blocking pattern comprising four third subpatterns arranged two-dimensionally, and disposed between adjacent ones of the first dipole antenna patterns on a lower side of the first blocking pattern, wherein the four third subpatterns are disposed to vertically overlap with the four first subpatterns.

5. The antenna apparatus of claim 1, wherein the first blocking pattern is connected to the first ground plane.

6. The antenna apparatus of claim 1, wherein the first blocking pattern is spaced apart from the first ground plane.

7. The antenna apparatus of claim 1, further comprising:

a second ground plane disposed below the first ground plane; and a second blocking pattern disposed on a side of the second ground plane facing the first dipole antenna patterns and having at least a portion overlapping the first blocking pattern in a normal direction of the first and second ground planes.

8. The antenna apparatus of claim 7, further comprising shielding vias disposed along a perimeter of the first ground plane and connected to the second ground plane, wherein a region between the first blocking pattern and the second blocking pattern is filled with an insulating layer.

9. The antenna apparatus of claim 7, further comprising shielding vias disposed along a perimeter of the first ground plane on a side facing the first dipole antenna patterns and connected to the second ground plane.

10. The antenna apparatus of claim 1, further comprising:

second dipole antenna patterns disposed below corresponding ones of the first dipole antenna patterns; and radial vias connecting the first dipole antenna patterns and the second dipole antenna patterns.

11. The antenna apparatus of claim 1, wherein the first ground plane comprises a through-hole through which a wiring via penetrates.

12. The antenna apparatus of claim 1, further comprising wiring lines configured to function as a transfer pathway for a radio frequency (RF) signal and electrically connected to corresponding ones of the feed lines, wherein the first ground plane surrounds each wiring line.

13. The antenna apparatus of claim 12, wherein the first ground plane comprises a cavity facing a rear of the first dipole antenna and the rear of the first dipole antenna is recessed in the cavity.

14. The antenna apparatus of claim 13, wherein the first ground plane comprises a protrusion region disposed in the cavity protruding toward the rear of the first dipole antenna.

15. The antenna apparatus of claim 1, further comprising:

an integrated circuit (IC) configured to transmit and/or receive a radio frequency (RF) signal and disposed below the first ground member;

a patch antenna pattern disposed above the first ground member;

a second ground plane disposed between the first ground plane and the IC; and a third ground plane disposed between the first ground plane and the patch antenna pattern.

16. The antenna apparatus of claim 1, further comprising a second ground plane disposed below the first ground plane, wherein boundaries of the first and second ground planes overlap each other in a normal direction of the first and second ground planes.

17. The antenna apparatus of claim 1, further comprising:

patch antenna patterns disposed above the first ground plane;

second feed vias connecting the patch antenna patterns; and a coupling member surrounding each of the patch antenna patterns, wherein a perimeter or a portion of the coupling member overlaps a perimeter of the first ground plane in a normal direction of the first ground plane.

18. The antenna apparatus of claim 1, further comprising:

patch antenna patterns disposed above the first ground plane; and second feed vias connecting the patch antenna patterns, wherein the first dipole antenna patterns and the patch antenna patterns are disposed in a 1×n arrangement where n is a natural number, and wherein the number of first blocking patterns is n+1 when first blocking patterns are disposed on an edge of the first dipole antenna patterns.

19. The antenna apparatus of claim 1, wherein the first dipole antenna patterns are disposed adjacently to side surfaces of the antenna apparatus and in parallel to each other.

20. The antenna apparatus of claim 1, further comprising patch antenna patterns disposed adjacent to an upper level of the antenna apparatus.

21. The antenna apparatus of claim 1, further comprising:

an integrated circuit (IC) electrically connected to a wiring line configured to transmit and/or receive a radio frequency (RF) signal and disposed below the first ground member;

an adhesive bonding the integrated circuit below the first ground member;

an electrical connection structure electrically connecting the IC to the wiring line; and an encapsulant encapsulating a portion of the IC.

22. The antenna apparatus of claim 21, further comprising a passive component disposed below the first ground member and electrically connected to a wiring line and/or the first ground plane.

23. An electronic device, comprising:

a side boundary;

a set substrate;

an antenna apparatus of claim 1 disposed on the set substrate; and a patch antenna pattern, wherein the first dipole antenna patterns and the patch antenna pattern are disposed adjacent to the side boundary.

* * * * *